US007111740B2

(12) United States Patent
Ogawa et al.

(10) Patent No.: US 7,111,740 B2
(45) Date of Patent: Sep. 26, 2006

(54) SORTING APPARATUS, SORTING METHOD AND ALIGNMENT APPARATUS

(75) Inventors: Fumihiro Ogawa, Hirakata (JP); Koji Tsutsumi, Suita (JP); Satoko Hirahara, Hirakata (JP)

(73) Assignee: Daiichi Jitsugyo Viswill Co., Ltd., Suita (JP)

( * ) Notice: Subject to any disclaimer, the term of this patent is extended or adjusted under 35 U.S.C. 154(b) by 199 days.

(21) Appl. No.: 10/705,090

(22) Filed: Nov. 10, 2003

(65) Prior Publication Data

US 2005/0040082 A1 Feb. 24, 2005

(30) Foreign Application Priority Data

Aug. 8, 2003 (JP) ..... 2003-289939
Aug. 8, 2003 (JP) ..... 2003-289940

(51) Int. Cl.
*B07C 5/02* (2006.01)

(52) U.S. Cl. ..... 209/539; 209/643; 209/644; 209/576; 209/541; 209/577; 198/445

(58) Field of Classification Search ..... 209/643
See application file for complete search history.

(56) References Cited

U.S. PATENT DOCUMENTS

| | | | | |
|---|---|---|---|---|
| 488,211 | A * | 12/1892 | Long | 209/393 |
| 4,446,959 | A | 5/1984 | Dunlap | 198/382 |
| 4,602,716 | A * | 7/1986 | Barla-Szabo et al. | 209/599 |
| 4,992,949 | A | 2/1991 | Arden | 364/478 |
| 5,645,171 | A * | 7/1997 | Felden | 209/139.1 |
| 6,150,158 | A * | 11/2000 | Bhide et al. | 435/286.3 |
| 6,213,709 | B1 * | 4/2001 | Hebrank | 414/737 |
| 6,248,968 | B1 * | 6/2001 | Suzuki et al. | 209/576 |
| 6,635,840 | B1 * | 10/2003 | Mailloux | 209/586 |
| 6,688,037 | B1 * | 2/2004 | Keller et al. | 47/1.01 P |
| 2003/0188998 | A1 * | 10/2003 | Deppermann | 209/592 |
| 2005/0082207 | A1 * | 4/2005 | Deppermann | 209/592 |

FOREIGN PATENT DOCUMENTS

| | | |
|---|---|---|
| JP | 59-212315 | 12/1984 |
| JP | 60-15310 | 1/1985 |
| JP | 61-107139 | 5/1986 |
| JP | 3-179244 | 8/1991 |
| JP | 3-229678 | 10/1991 |
| JP | 4-346877 | 12/1992 |
| JP | 5-154744 | 6/1993 |
| JP | 6-099143 | 4/1994 |
| JP | 6-167454 | 6/1994 |
| JP | 7-39824 | 2/1995 |

(Continued)

OTHER PUBLICATIONS

International Search Report.

(Continued)

*Primary Examiner*—Kathy Matecki
*Assistant Examiner*—Jonathan R. Miller
(74) *Attorney, Agent, or Firm*—Morgan & Finnegan, LLP

(57) ABSTRACT

This invention provides a seed-sorting apparatus that includes an alignment trough having a plurality of grooves into which the seeds are distributed, a line sensor camera for inspecting the seeds, a nozzle device having a number of nozzles that is the same as the number of grooves on the upper surface of the alignment trough, and a control unit. The control unit, through a series of calculations, is capable of differentiating between different types of seeds and can direct a seed sorting and sucking device to suck the seed.

9 Claims, 17 Drawing Sheets

FOREIGN PATENT DOCUMENTS

| | | |
|---|---|---|
| JP | 7-113751 | 5/1995 |
| JP | 7-232136 | 9/1995 |
| JP | 8-131966 | 5/1996 |
| JP | 8-252542 | 10/1996 |
| JP | 10-35862 | 2/1998 |
| JP | 2001-314822 | 11/2001 |
| JP | 3334003 | 8/2002 |

OTHER PUBLICATIONS

Written Opinion by ISA.

* cited by examiner

SORTING APPARATUS, SORTING METHOD AND ALIGNMENT APPARATUS

BACKGROUND OF THE INVENTION

1. Field of the Invention

The present invention relates to a sorting apparatus and a sorting method for sorting a desired article from a plurality of articles to be sorted, and an alignment apparatus for transporting a plurality of articles to be sorted.

2. Description of the Background Art

It is required that articles which belong to a desired category be sorted from a plurality of articles having various colors, sizes, etc. Conventionally, desired articles have been sorted based on the color, size, etc., of the articles to be sorted through the human eyesight. In recent years, sorting apparatuses have been proposed which sort desired articles using CCD (charge-coupled device) cameras (refer to, for example, JP-A-04-346877).

In the sorting apparatus according to the above-described JP-A-04-346877, the seeds are transported at intervals by a transport apparatus with a vibration generator, and the image of each of the seeds is obtained by a CCD camera. The color or size of the seed is determined based on the image of the seed obtained by the CCD camera, and the seeds determined to be rejected are sucked and extracted by an extraction device, so that the seeds are classified into accepted seeds and rejected seeds.

In the sorting apparatus according to the above-described patent document, however, the seeds are transported by the vibrations by the vibration generator in the transport apparatus, and therefore, the seed-transporting speed is low. As a result, it requires a great deal of time to sort the seeds. Moreover, since the color or size of the vibrating seeds is determined, it is difficult to accurately sort the seeds.

On the other hand, as a seed sorting apparatus for sorting seeds according to the genetic traits, an apparatus has been provided which sorts seeds by measuring the condition of the surface design of a seed and binarizing the measured result to compare this binarized image with a value of reference distribution of a seed stored in a storage in advance(refer to, for example, JP-B-3334003).

In the above-described seed sorting apparatus, however, the seeds are sorted by converting the image of the surface design of a seed into a binarized monochrome image, and therefore, it has been difficult to sort the seeds having the same surface condition with different colors.

Further, a seed sorting apparatus has been also provided which sorts the seeds according to color by a color sensor. It has been difficult, however, to accurately sort the identical seeds when some of them have non-uniformity in color. It has also been difficult to accurately sort the seeds according to color when some of them have white parts, that is, no color at their peripheries or string parts inside.

SUMMARY OF THE INVENTION

An object of the present invention is to provide a sorting apparatus and a sorting method capable of efficiently and accurately sorting a large amount of articles to be sorted.

Another object of the present invention is to provide an alignment apparatus capable of efficiently and accurately transporting a large amount of articles to be sorted.

Still another object of the present invention is to provide a seed sorting apparatus capable of accurately sorting various kinds of seeds.

A sorting apparatus according to one aspect of the present invention comprises an alignment apparatus that aligns a plurality of articles to be sorted in a plurality of rows while transporting the articles in a first direction; a transport apparatus that transports the plurality of articles supplied from the alignment apparatus in the state of plurality of rows in the first direction; a line sensor that photographs a linear measurement region along a second direction perpendicular to the first direction in the transport apparatus; a suction device having a plurality of suction units arranged along the second direction on the downstream side of the measurement region of the transport apparatus to suck the articles to be sorted in the respective plurality of rows transported by the transport apparatus; a determiner that determines whether each of the articles to be sorted in the plurality of rows transported by the transport apparatus is to be selected or not selected based on an output signal from the line sensor; and a controller that controls suction operation of each of the plurality of suction units of the suction device based on the determination result by the determiner.

In the sorting apparatus according to the present invention, the plurality of articles to be sorted are aligned in the plurality of rows while being transported in the first direction by the alignment apparatus, and the plurality of articles to be sorted supplied from the alignment apparatus are transported in the first direction by the transport apparatus in the state of plurality of rows. This makes it possible to efficiently transport a large amount of articles to be sorted.

In addition, it is determined by the determiner whether each of the articles to be sorted in the plurality of rows transported by the transport apparatus is to be selected or not selected based on the output signal from the line sensor, and the suction operation of each of the plurality of suction units is controlled based on the determination result by the determiner. This makes it possible to accurately sort each of the articles to be sorted.

Further, it is immediately determined whether the article to be sorted is to be selected or not selected based on the output signal from the line sensor, each time the article to be sorted in each of the rows passes by. It is thus possible to accurately determine whether the article to be sorted is to be selected or not selected, even when the article to be sorted is transported at a high speed.

As a result of these, a large amount of articles to be sorted can be efficiently and accurately sorted.

The suction device may comprise a main part having a gas path; and a tubular nozzle having one opening end and another opening end, and inserted into the gas path so that the one opening end projects from the main part, a gap may be provided between at least part of an outer surface on the side of the other opening end and an inner surface of the gas path, and the main part may have a gas flow-in path communicating with the gap and having a larger cross section than that of the gap, and the suction device may further comprise a gas creating device that creates a gas flow via the gas flow-in path running from the side of one opening end toward the side of other opening end in the gap.

In this case, the gas flow running from the side of the one opening end toward the side of the other opening end is created in the gap by the gas creating device via the gas flow-in path. In this case, since the cross section of the gas flow-in path is larger than the cross section of the gap, the speed of the gas flow running in the gap is drastically increased. This causes a negative pressure around the side of the other opening end of the tubular nozzle, thereby producing a gas flow running toward the side of the other opening end from the side of the one opening end inside the tubular nozzle. As a result, the article to be sorted transported by the transport apparatus is sucked by the tubular nozzle.

A speed of the articles to be sorted in the plurality of rows transported by the transport apparatus may be set to a value greater than a speed of the articles to be sorted in the plurality of rows transported by the alignment apparatus. In this case, an interval between adjacent ones of the plurality of articles to be sorted transported by the alignment apparatus is larger than an interval between adjacent ones of the plurality of articles to be sorted transported by the transport apparatus. This makes it possible to individually determine each one of the articles to be sorted. Accordingly, error determination caused by an overlap of the plurality of articles to be sorted in a transporting direction can be prevented.

The alignment apparatus may include an alignment member having a plurality of grooves extending in parallel with one another along the first direction; and a vibration generation device that vibrates the alignment member so that the plurality of articles to be sorted supplied on the alignment member move along the plurality of grooves.

In this case, the plurality of articles to be sorted supplied to the alignment member are moved by the vibrations generated by the vibration generation device. Accordingly, a large amount of articles to be sorted are efficiently distributed into the plurality of grooves to move in each of the grooves.

An opening may be provided in a bottom surface of each of the plurality of grooves of the alignment apparatus, and the width of the opening may be set to form a bottom-surface region on which the articles to be sorted can pass on a side of the opening of each of the grooves.

In this case, extra articles to be sorted fall through the openings, and the articles to be sorted are aligned in a row in each of the grooves. This makes it possible to individually determine each of the plurality of articles to be sorted. Accordingly, error determination caused by an overlap of the plurality of articles to be sorted in a width direction while being transported can be prevented.

The alignment apparatus may further comprise a recovery device that recovers the article to be sorted fallen through each of the openings of the alignment apparatus to supply the recovered article to an upstream side of the alignment apparatus. In this case, extra articles to be sorted on the alignment apparatus are automatically resupplied to the alignment apparatus. This eliminates the operation of supplying again the fallen articles to be sorted to the alignment apparatus, thereby enhancing efficiency of operation.

The transport apparatus may have a transporting surface that moves in the first direction, and the alignment apparatus may supply the plurality of articles to be sorted in the plurality of rows on the transporting surface. In this case, the articles to be sorted supplied on the transporting surface from the alignment apparatus are transported by the transport apparatus while maintaining their plurality of rows. This makes it possible to individually determine each one of the articles to be sorted. Accordingly, sorting can be accurately performed.

The controller may instruct a corresponding suction unit to perform suction operation after the elapse of a predetermined time from the time point when the article to be sorted in each of the rows is determined to be selected by the determiner. In this case, the articles to be sorted can be efficiently classified.

The determiner may detect a width of the article to be sorted in the second direction based on the output signal from the line sensor, and determine that the article to be sorted is being transported by the transport apparatus when the width in the second direction is greater than a predetermined value consecutively a predetermined number of times. In this case, the article to be sorted having a desired width is an object to be determined. This reduces error determination by the determiner.

After determining that the articles to be sorted are being transported by the transport apparatus, the determiner may measure a distribution of luminances of the measurement region to determine whether each of the articles to be sorted is to be selected or not selected based on a most frequent luminance. In this case, it is possible to sort the articles even when some of them have different colors from one another.

A sorting method according to another aspect of the present invention includes the steps of aligning a plurality of articles to be sorted in a plurality of rows while transporting the articles in a first direction; transporting the plurality of articles to be sorted in the state of plurality of rows in the first direction; photographing by a line sensor a linear measurement region along a second direction perpendicular to the first direction; determining whether each of the plurality of articles to be sorted in the plurality of rows is to be selected or not selected based on an output signal from the line sensor; and sucking the plurality of articles to be sorted in the respective plurality of rows based on the determination result by a plurality of suction units arranged along the second direction on the downstream side of the measurement region.

In the sorting method according to the present invention, the plurality of articles to be sorted are aligned in the plurality of rows while being transported in the first direction, and the plurality of articles to be sorted are transported in the first direction by the transport apparatus in the state of plurality of rows. This makes it possible to efficiently transport a large amount of articles to be sorted.

In addition, it is determined whether each of the articles to be sorted in the plurality of rows is to be selected or not selected based on the output signal from the line sensor, and the suction operation of each of the plurality of suction units is controlled based on the determination result. This makes it possible to accurately sort each of the articles to be sorted.

Further, it is immediately determined whether the article to be sorted is to be selected or not selected based on the output signal from the line sensor, each time the article to be sorted in each of the rows passes by. It is thus possible to accurately determine whether the article to be sorted is to be selected or not selected, even when the article to be sorted is transported at a high speed.

As a result of these, a large amount of articles to be selected can be efficiently and accurately sorted.

An alignment apparatus according to still another aspect of the present invention is an alignment apparatus that aligns a plurality of articles to be sorted in a plurality of rows while transporting the articles in a first direction, comprising an alignment member having a plurality of grooves extending in parallel with one another along the first direction; and a vibration generation device that vibrates the alignment member so that the plurality of articles to be sorted supplied on the alignment member move along the plurality of grooves, wherein an opening is provided in a bottom surface of each of the plurality of grooves of the alignment apparatus, and the width of the opening is set to form a bottom-surface region on which the articles to be sorted can pass on a side of the opening of each of the grooves, and a notch is provided in a front end of the bottom surface on an extending line from the bottom-surface region of each of the plurality of grooves.

In the alignment apparatus according to the present invention, the vibrations generated by the vibration generation device cause the plurality of articles to be sorted supplied to the alignment apparatus to be aligned in the plurality of rows along the plurality of grooves while being transported in the first direction, and extra articles to be sorted fall through the openings, and the articles to be sorted are aligned in a row in each of the grooves, and the articles to be sorted fallen from the notches to move along each of the grooves.

This makes it possible for the seeds supplied from the notches to a following transport apparatus to be transported without deforming the rows formed along the plurality of grooves. Accordingly, each one of the articles to be sorted can be individually transported in each of the rows. As a result, a large amount of articles to be sorted can be efficiently and accurately transported.

In the sorting apparatus, sorting method, and alignment apparatus according to the present invention, a large amount of articles to be sorted can be efficiently and accurately sorted.

In addition, the alignment apparatus according to the present invention is capable of efficiently and accurately transporting a large amount of articles to be sorted.

A nozzle device according to still another aspect of the present invention is a nozzle device that sucks a target object on a supporting surface, comprising a main part having a gas path; and a tubular nozzle having one opening end and another opening end, and inserted into the gas path so that the one opening end projects from the main part, a gap may be provided between at least part of an outer surface on the side of the other opening end and an inner surface of the gas path, and the main part may have a gas flow-in path communicating with the gap and having a larger cross section than that of the gap, and the suction device may further comprise a gas creating device that creates a gas flow via the gas flow-in path running from the side of one opening end toward the side of other opening end in the gap.

In the nozzle device according to the present invention, the gas flow running from the side of the one opening end toward the side of the other opening end is created in the gap by the gas creating device. In this case, since the cross section of the gas flow-in path is larger than the cross section of the gap, the speed of the gas flow running in the gap is drastically increased. This causes a negative pressure around the side of the other opening end of the tubular nozzle, thereby producing a gas flow running toward the side of the other opening end from the side of the one opening end inside the tubular nozzle. As a result, the article on the supporting surface is sucked by the tubular nozzle.

Part of the tubular nozzle on the side of the one opening end may extend in the vertical direction with respect to the supporting surface, and part of the tubular nozzle on the side of the other opening end may extend so as to be inclined with respect to the supporting surface.

In this case, since the part of the tubular nozzle on the side of the one opening end extends in the vertical direction with respect to the supporting surface, the cross section of the one opening end of the tubular nozzle can be suppressed to its minimum. This prevents reduction in the suction force of the tubular nozzle without distribution of the suction force. This further prevents an object other than the target object from being sucked.

Moreover, since the part of the tubular nozzle on the side of the other opening end of the tubular nozzle extends so as to be inclined with respect to the supporting surface, the target object is prevented from easily falling. Accordingly, the target objects can be efficiently sucked.

A seed sorting apparatus according to still another aspect of the present invention is a seed sorting apparatus that sorts seeds, comprising an image input device that inputs an image of a seed; a frequency distribution maker that extracts a region having luminance values within a preset range in the image of the seed input by the image input device to make a frequency distribution of luminance values of the extracted region; a complexity calculator that calculates the peripheral length and the area of the seed in the image of the seed input by the image input device to calculate a degree of complexity based on the calculated peripheral length and the area; and a sorter that sorts the seeds based on the frequency distribution made by the frequency distribution maker and the degree of complexity calculated by the complexity calculator.

The degree of complexity herein represents the extent to which the seed is close to or away from a round shape, which is expressed by a value proportional to the ratio of the peripheral length to the area or the ratio of the area to the peripheral length.

In the seed sorting apparatus according to the present invention, the image of the seed is input by the image input device, and the region having luminance values within the preset range in the input image of the seed is extracted by the frequency distribution maker, and the frequency distribution of the luminance values in the extracted region is made. Moreover, the seeds are sorted by the sorter based on the degree of complexity calculated by the complexity calculator based on the peripheral length and the area of the seed and the frequency distribution of the luminances made by the frequency distribution maker.

Sorting can be therefore performed based on the luminance values within a certain range. As a result, it is possible to accurately sort the seeds even when some of them have non-uniformity of color in the identical seeds, or when some of them have no color at their peripheries or string parts.

Moreover, since the sorting is performed based on the frequency distributions of the degrees of complexity and the luminance values, it is possible to sort the seeds even when they have the same color and different shapes, or have the same shape and different colors. The seeds can also be sorted from foreign matter.

The sorter may include a most frequent luminance value extractor that extracts a luminance value having a highest frequency in the frequency distribution made by the frequency distribution maker; a first storage that stores a preset reference value of luminance; a first comparator that compares a most frequent luminance value extracted by the most frequent luminance value extractor with the reference value of luminance stored in the first storage; a second storage that stores a preset reference value of degree of complexity; a second comparator that compares the degree of complexity calculated by the complexity calculator with the reference value of degree of complexity stored in the second storage; and a determiner that determines whether the seed belongs to a predetermined kind based on the comparison result by the first comparator and the comparison result by the second comparator.

In this case, the most frequent luminance value extracted by the most frequent luminance extractor and the reference value of luminance stored in the first storage are compared by the first comparator, and the degree of complexity calculated by the complexity calculator and the reference value of degree of complexity stored in the second storage are compared by the second comparator. In addition, it is determined whether the seed belongs to a predetermined kind by the determiner based on the comparison result by the first comparator and the comparison result by the second comparator. By arbitrarily changing each of the reference value of luminance stored in the first storage and the reference value of degree of complexity stored in the second storage, it becomes possible to sort various kinds of seeds.

The seed sorting apparatus may further comprise a reference calculator that makes a frequency distribution of luminance values for a plurality of kinds of seeds to calculate the reference value of luminance based on a plurality of peaks in said frequency distribution of luminance values.

In this case, the reference value of luminance is automatically calculated based on the plurality of peaks of the luminance values, so as to eliminate the operation of setting the reference value of luminance, and enhance efficiency of operation.

The image input device may include a transport apparatus that transports the seeds in a first direction; and a line sensor that photographs a linear region along a second direction perpendicular to the first direction.

In this case, the image of the seed being transported in the first direction by the transport apparatus is accurately and immediately photographed by the line sensor. This enables the seeds to be rapidly and accurately sorted.

The seed sorting apparatus may further comprise a length calculator that calculates the length of the seed based on the image input by the image input device, and the sorter may sort the seeds based on the frequency distribution made by the frequency distribution maker, the degree of complexity calculated by the complexity calculator, and the length of the seed calculated by the length calculator.

In this case, the seeds are sorted based on the length of the seed calculated by the length calculator, the frequency distribution made by the frequency distribution maker, and the degree of complexity calculated by the complexity calculator. This even makes it possible to sort the seeds having similar shapes and colors while having different sizes.

A seed-sorting method according to still another aspect of the present invention comprises the steps of: inputting the image of a seed; extracting a region having luminance values within a preset range to make a frequency distribution of the luminance values of the extracted region; calculating the peripheral length and area of the seed in the image of the input seed to calculate the degree of complexity based on the calculated peripheral length and area; and sorting the seeds based on the made frequency distribution and calculated degree of complexity.

In the seed-sorting method according to the present invention, the image of the seed is input, and the region having the luminance values within the preset range in the input image of the seed is extracted, and the frequency distribution of the luminance values in the extracted region is made. Moreover, the seeds are sorted based on the degree of complexity obtained based on the calculated peripheral length and area of the seed and the frequency distribution of the luminance values.

Sorting can be therefore performed based on the luminance values within a certain range. As a result, it is possible to accurately sort the seeds even when some of them have non-uniformity of color in the identical seeds, or when some of them have no color at their peripheries or string parts.

Moreover, since the sorting is performed based on the frequency distributions of the degrees of complexity and the luminance values, it is possible to sort the seeds even when they have the same color and different shapes, or have the same shape and different colors. The seeds can also be sorted from foreign matter.

A seed sorting apparatus according to still another aspect of the present invention is a seed sorting apparatus that sorts seeds, comprising an alignment apparatus that aligns a plurality of articles to be sorted in a plurality of rows while transporting the plurality of seeds in a first direction; a transport apparatus that transports the plurality of seeds supplied from the alignment apparatus in the state of plurality of rows in the first direction; a line sensor that photographs a linear measurement region along a second direction perpendicular to the first direction in the transport apparatus; a frequency distribution maker that extracts a region having luminance values within a preset range in the image of the seed input by the line sensor to make a frequency distribution of the luminance values of the extracted region; a complexity calculator that calculates the peripheral length and the area of the seed in the image of the seed input by the line sensor to calculate a degree of complexity based on the calculated peripheral length and the area; a determiner that determines whether each of the seeds in the plurality of rows transported by the transport apparatus is to be selected or not selected based on the frequency distribution made by the frequency distribution maker and the degree of complexity calculated by the complexity calculator; a suction device having a plurality of suction units arranged along the second direction on the downstream side of the measurement region of the transport apparatus to suck the seeds in the respective plurality of rows transported by the transport apparatus; and a controller that controls suction operation of each of the plurality of suction units of the suction device based on the determination result by the determiner.

In the seed sorting apparatus according to the present invention, the plurality of seeds are aligned in the plurality of rows while being transported in the first direction by the alignment apparatus, and the plurality of seeds supplied from the alignment apparatus are transported in the first direction by the transport apparatus in the state of plurality of rows. This makes it possible to efficiently transport a large amount of seeds.

The image of the seed is obtained by the line sensor, and the region having the luminance values within the preset range in the obtained image of the seed is extracted by the frequency distribution maker, and the frequency distribution of the luminance values in the extracted region is made. Moreover, it is determined by the determiner whether each of the seeds in the plurality of rows transported by the transport apparatus is to be selected or not selected based on the degree of complexity obtained based on the peripheral length and area of the seed calculated by the complexity calculator and the frequency distribution of the luminance values made by the frequency distribution maker. Further, the suction operation of each of the plurality of suction units is controlled based on the determination result by the determiner.

Sorting can be therefore performed based on the luminance values within a certain range. As a result, it is possible to accurately sort the seeds even when some of them have non-uniformity of color in the identical seeds, or when some of them have no color at their peripheries or string parts.

Moreover, since the sorting is performed based on the frequency distributions of the degrees of complexity and the luminance values, it is possible to sort the seeds even when they have the same color and different shapes, or have the same shape and different colors. The seeds can also be sorted from foreign matter.

Further, it is immediately determined whether the seed is to be selected or not selected based on the image obtained by the line sensor, each time the seed in each of the rows passes by. It is thus possible to accurately determine whether the seed is to be selected or not selected, even when the seed is transported at a high speed. As a result, a large amount of seeds can be efficiently and accurately sorted.

BRIEF DESCRIPTION OF THE DRAWINGS

FIG. 3(*b*) is a front view of the alignment trough; FIG. 3(*c*) is an A—A line cross-sectional view of FIG. 3(*a*); and FIG. 3(*d*) is a B—B line cross-sectional view of FIG. 3(*a*);

DESCRIPTION OF THE PREFERRED EMBODIMENTS

A sorting apparatus and a sorting method according to embodiments of the present invention will be hereinafter described with reference to the drawings. In the present embodiment, an apparatus and a method for sorting seeds will be described as one example of the sorting apparatus and the sorting method according to the present invention.

In the following description, seeds that have approximate round shapes with a diameter of several mm, such as those of wallflowers (stocks), will be sorted as one example. The seeds of wallflowers are classified into black and brown seeds, and they differ in several respects, such as opening of the petals, depending on the difference of the color. It is therefore desired that the black seeds and brown seeds be sorted from each other.

Figure 1:
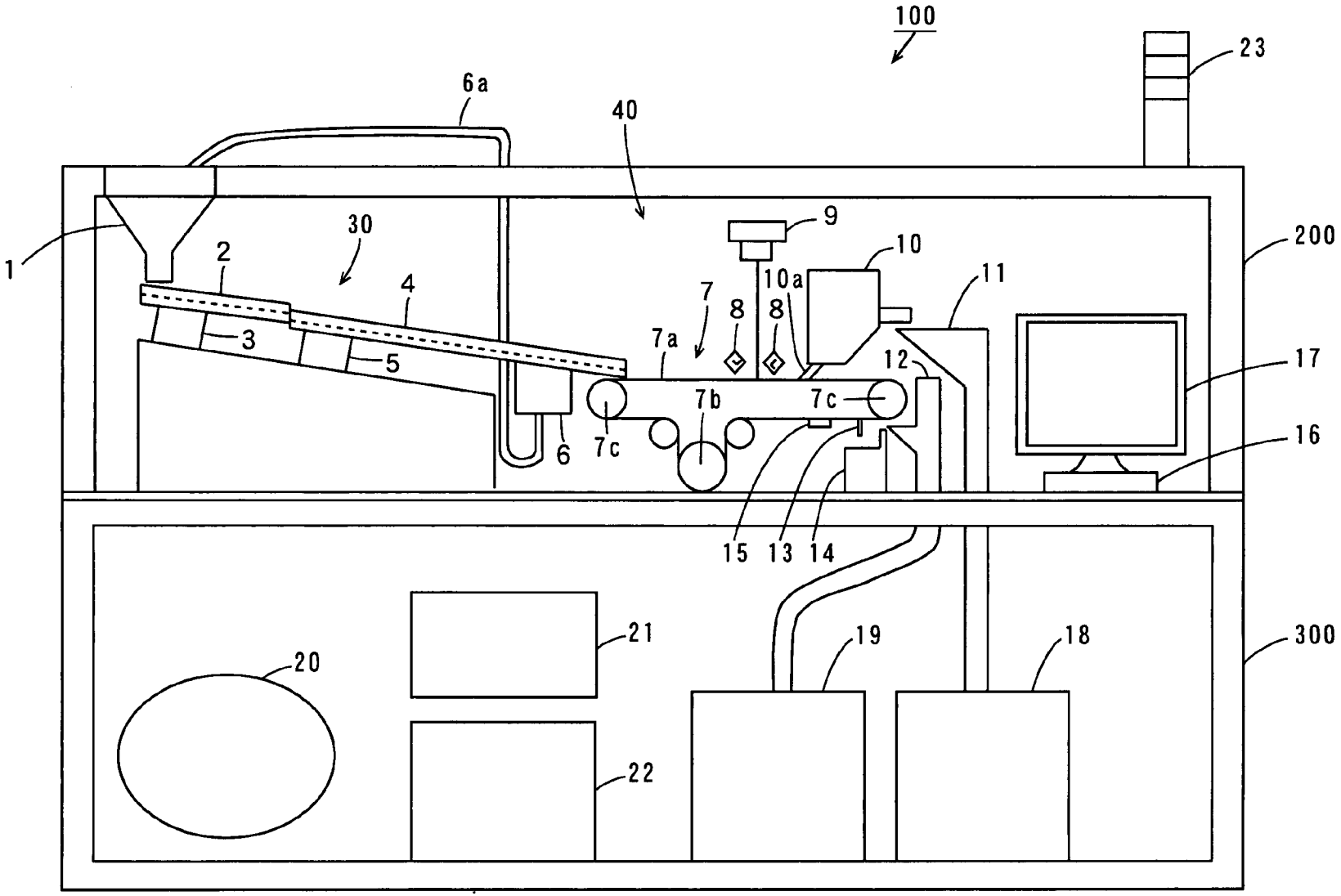
FIG. 1 is a schematic view of a sorting apparatus according to one embodiment of the present invention.

FIG. 1 is a schematic view of a sorting apparatus according to one embodiment of the present invention.

As shown in FIG. 1, a sorting apparatus 100 comprises an upper casing 200 and a lower casing 300. In the upper casing 200, a supply section 30, an inspection section 40, an accepted article guide 11, a rejected article guide 12, a dust collection vessel 14, an operation unit 16, and a display 17 are provided.

The supply section 30 comprises a supply hopper 1, a supply trough 2, a vibration generator 3, an alignment trough 4, and a vibration generator 5. The inspection section 40 comprises an inspection conveyor 7, lights 8, a line sensor camera 9, a nozzle device 10, a scraper 13, and a sponge 15.

The supply hopper 1 is provided to have an opening on an upper surface of the upper casing 200. The supply trough 2 is inclined so that its one end becomes higher than the other end. Seeds Z supplied into the supply hopper 1 are discharged on one end of an upper surface of the supply trough 2.

The vibration generator 3 is provided on a lower surface of the supply trough 2. Vibrations generated by the vibration generator 3 cause the seeds Z supplied on the upper surface of the supply trough 2 to gradually move toward the other end of the supply trough 2, and the seeds Z are supplied to one end of an upper surface of the alignment trough 4.

The alignment trough 4 is inclined so that its one end becomes higher than the other end. The vibration generator 5 is provided on one end of a lower surface of the alignment trough 4. Vibrations generated by the vibration generator 5 cause the seeds Z supplied on the upper surface of the alignment trough 4 to gradually move toward the other end of the alignment trough 4.

An overflow recovery device 6 is provided on the other end of the lower surface of the alignment trough 4. The overflow recovery device 6 is connected to the supply hopper 1 via a hose 6*a*. When an excess amount of the seeds Z are supplied on the alignment trough 4, some of the seeds Z fall from the alignment trough 4 to be collected into the overflow recovery device 6.

Compressed air generated by the compressor 20 described below causes gas flow from the overflow recovery device 6 toward the supply hopper 1 within the hose 6*a*, whereby the seeds Z collected in the overflow recovery device 6 are re-supplied to-the supply hopper 1.

The inspection conveyor 7 is comprised of a belt 7*a*, a motor 7*b*, and a plurality of rollers 7*c*. The belt 7*a* extends over the motor 7*b* and rollers 7*c*. The belt 7*a* performs circulation operation in coordination with the rotation of the motor 7*b*. The seeds Z moving on the upper surface of the alignment trough 4 are supplied onto one end of the belt 7*a*. The seeds Z supplied on one end of the belt 7*a* are transported to the other end of the inspection conveyor 7 by the circulation operation of the belt 7*a*.

The belt 7*a* is made of white material. This enhances the color of the seeds Z supplied on the belt 7*a*, leading to higher accuracy of inspection of the seeds Z. It is noted that the belt 7*a* may be made of material having other color, depending on the kind of seeds to be inspected.

The lights 8, which are provided above the inspection conveyor 7, cast light toward a part of the belt 7*a*. Each of the lights 8 has a light source comprising red light-emitting devices (light-emitting diodes). This emphasizes a difference between black and brown, leading to higher accuracy of inspection of the seeds Z.

The line sensor camera 9, which includes line sensors made of CCDs (Charge-Coupled Devices) or the like, is provided above the lights 8 to photograph a linear region (hereinafter referred to as a measurement region) perpendicular to a moving direction of the belt 7*a* (hereinafter referred to as a transporting direction). An output signal from the line sensor camera 9 represents a luminance of the measurement region. The color of each of the seeds Z illuminated by the lights 8 is inspected based on the output signal from the line sensor camera 9 in a process described below.

The nozzle device 10 has a plurality of nozzles 10*a*. The plurality of nozzles 10*a* of the nozzle device 10 are arranged perpendicular to the transporting direction of the belt 7*a* at a predetermined distance from the region to be measured by the line sensor camera 9 in a downstream side. The black seed Z is sucked by a nozzle 10*a* to be collected in the accepted article guide 11. The seed Z that is not black falls from the other end of the inspection conveyor 7 without being sucked by the nozzle 10*a*, and is collected in the rejected article guide 12.

The scraper 13 and sponge 15 are provided on a lower part of the inspection conveyor 7 to be in contact with the belt 7*a*. Contaminants and the like adhering to the inspection conveyor are scraped off with the scraper 13 to be collected in the dust collection vessel 14. Contaminants and the like unscrapable with the scraper 13 are removed with the sponge 15.

The operation unit 16 comprises a keyboard, etc. The operation of each component in the sorting apparatus 100 is controlled by the operation of the operation unit 16 by a user. The display 17 displays operating condition of each component in the sorting apparatus 100.

Further, an emergency light 23 is provided above the upper casing 200. The emergency light 23 is turned on, for example, at the time of malfunction of the sorting apparatus 100, allowing a user to notice the occurrence of an abnormality.

In the lower casing 300, an accepted article collection vessel 18, a rejected article collection vessel 19, a compressor 20, a pneumatic device 21, and a control unit 22 are provided.

The seed Z sucked by the nozzle device 10 is stored in the accepted article collection vessel 18 via the accepted article guide 11. The seed Z collected by the rejected article guide 12 is stored in the rejected article collection vessel 19.

The compressor 20 generates compressed air necessary for the operations of the overflow recovery device 6, hose 6*a*, and nozzle device 10. The pneumatic device 21 comprises a tank, a regulator, etc. The compressed air generated by the compressor 20 is temporarily stored in the tank within the pneumatic device 21. The compressed air stored in the tank within the pneumatic device 21 is supplied to the overflow recovery device 6, hose 6*a*, and nozzle device 10 via the regulator, when needed.

The control unit 22, which is comprised of a CPU (Central Processing Unit), a semiconductor memory, or the like, controls the operation of each component in the sorting apparatus 100. The control unit 22 will be later described in detail.

Figure 2:
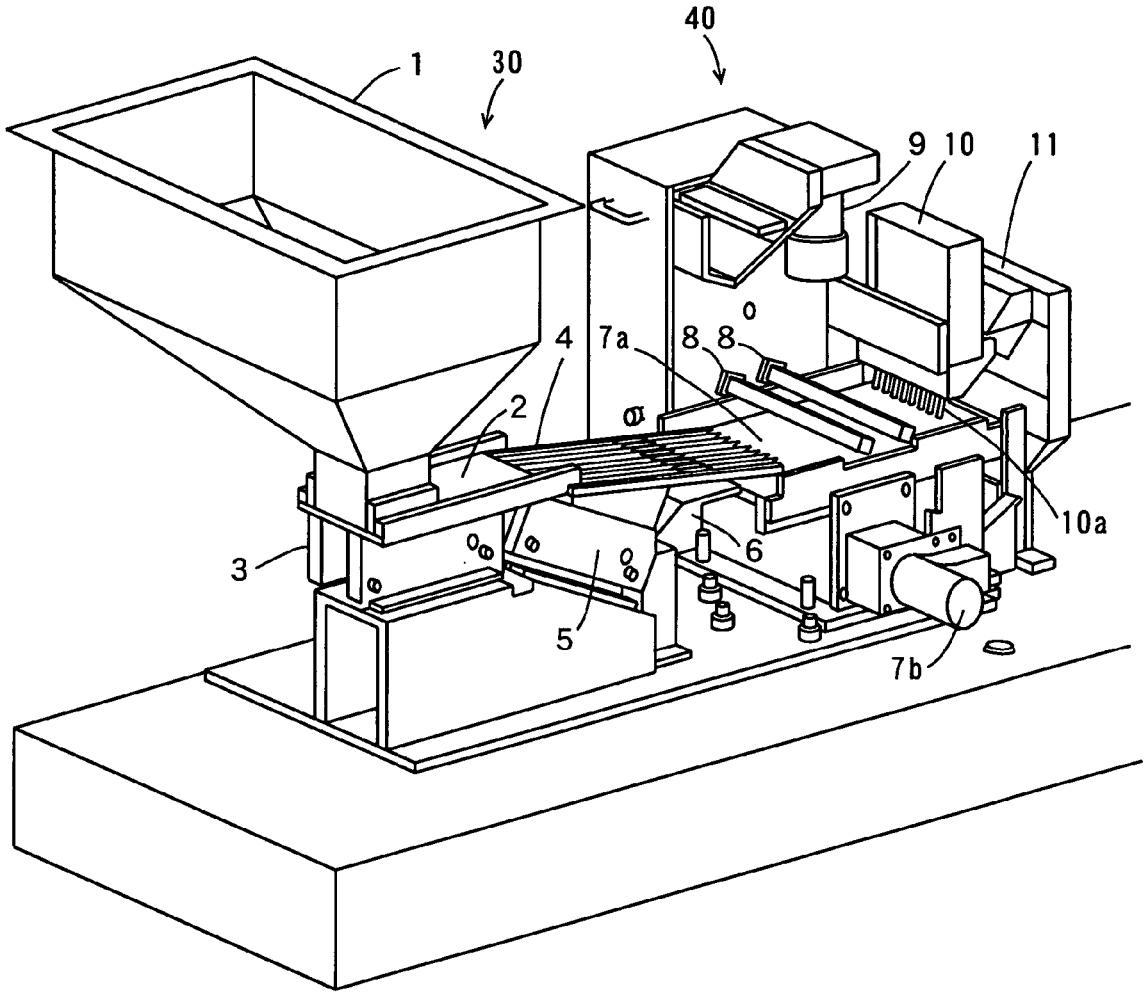
FIG. 2 is a perspective view of the supply section and the inspection section shown in FIG. 1.

FIG. 2 is a perspective view of the supply section 30 and the inspection section 40 shown in FIG. 1.

As shown in FIG. 2, since the supply trough 2 has a predetermined width, the seeds Z supplied from the supply hopper 1 spread in a width direction on the upper surface of the supply trough 2. In addition, a plurality of grooves are formed on the upper surface of the alignment trough 4, as described below. The seeds Z supplied from the supply trough 2 are thus distributed into the plurality of grooves on the upper surface of the alignment trough 4.

The seeds Z supplied from the alignment trough 4 form the number of rows corresponding to the number of the grooves on the upper surface of the alignment trough 4 also on the belt 7*a*. The line sensor camera 9 can thus perform inspection of the seeds for each row.

The nozzle device 10 comprises the number of nozzles corresponding to the number of the grooves on the upper surface of the alignment trough 4. The seed Z determined to be black based on the inspection of the line sensor camera 9 is sucked by each of the nozzles 10*a* of the nozzle device 10 for each row.

Figure 3:
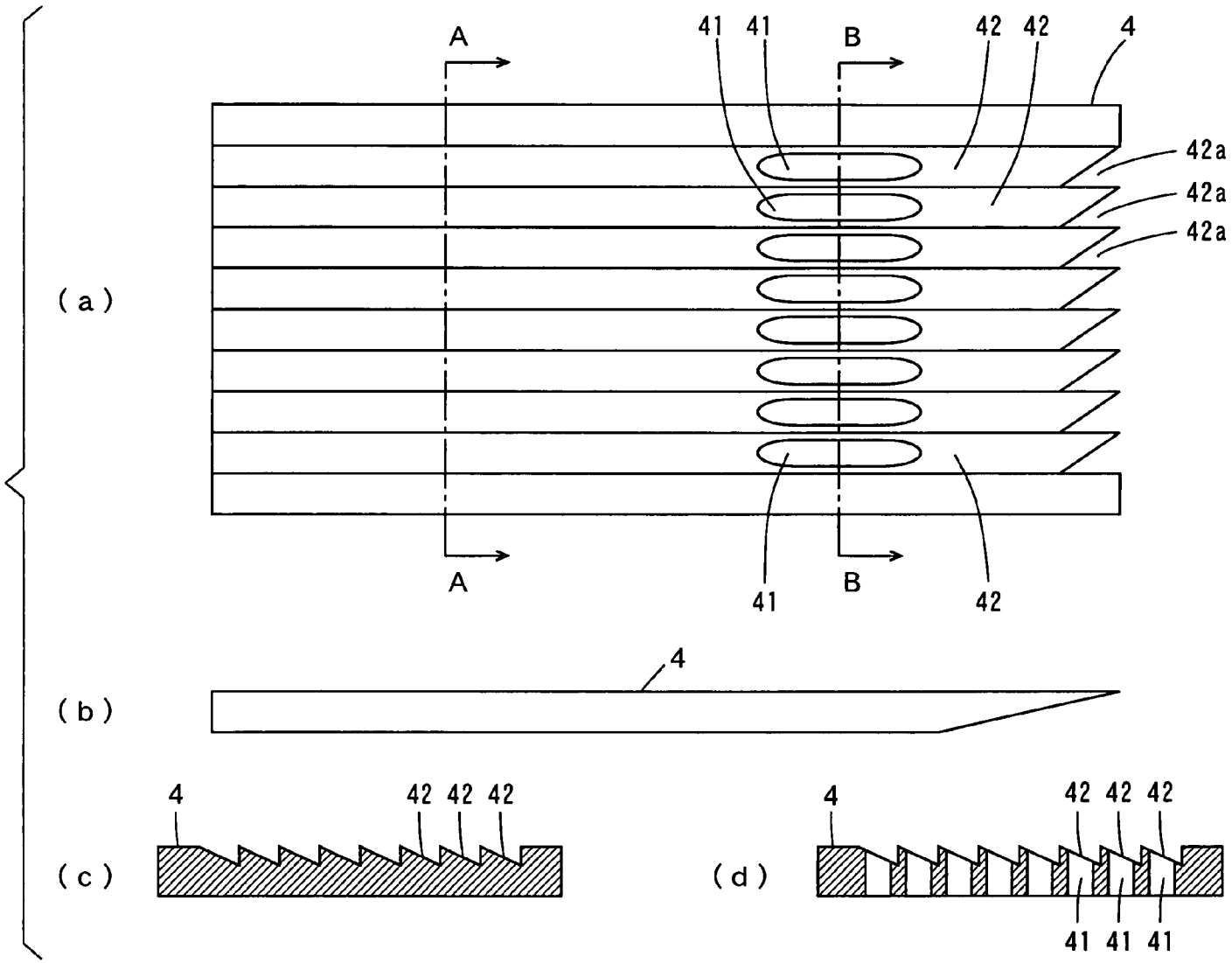
FIG. 3(*a*) is a plan view of an alignment trough.

FIG. 3(*a*) is a plan view of the alignment trough 4; FIG. 3(*b*) is a front view of the alignment trough 4; FIG. 3(*c*) is an A—A line cross-sectional view of FIG. 3(*a*); and FIG. 3 (d) is a B—B line cross-sectional view of FIG. 3(*a*).

As shown in FIG. 3(*a*), a plurality of grooves are formed extending from one end of the alignment trough 4 to the other end on the upper surface of the alignment trough 4. In the present embodiment, eight of grooves 42 are formed. There is provided a triangular notch 42*a* on a bottom surface of the other end of each of the grooves 42.

As shown in FIG. 3(*b*), a lower part of the other end of the alignment trough 4 has a shape obtained by being acutely cut off toward the other end.

In addition, as shown in FIG. 3(*c*), the plurality of grooves 42 are formed so that an inclined surface and a vertical surface alternately continue to form serrations. The seeds supplied from the supply trough 2 gradually move from one end of the alignment trough 4 toward the other end thereof, as they lean to a lower side of the inclined surface of each of the grooves 42.

Moreover, as shown in FIG. 3(*d*), an oval opening 41 is formed on a central part of the inclined surface of each of the grooves 42. The width of the inclined surface between the opening 41 and the vertical surface is set to that of one seed Z. As a result, extra seeds Z are to fall through the openings 41, even when a plurality of seeds Z move overlapping with one another in a width direction of the groove 42, so that the seeds Z supplied onto the belt 7*a* shown in FIG. 1 form the number of rows corresponding to the number of the grooves 42.

Figure 4:
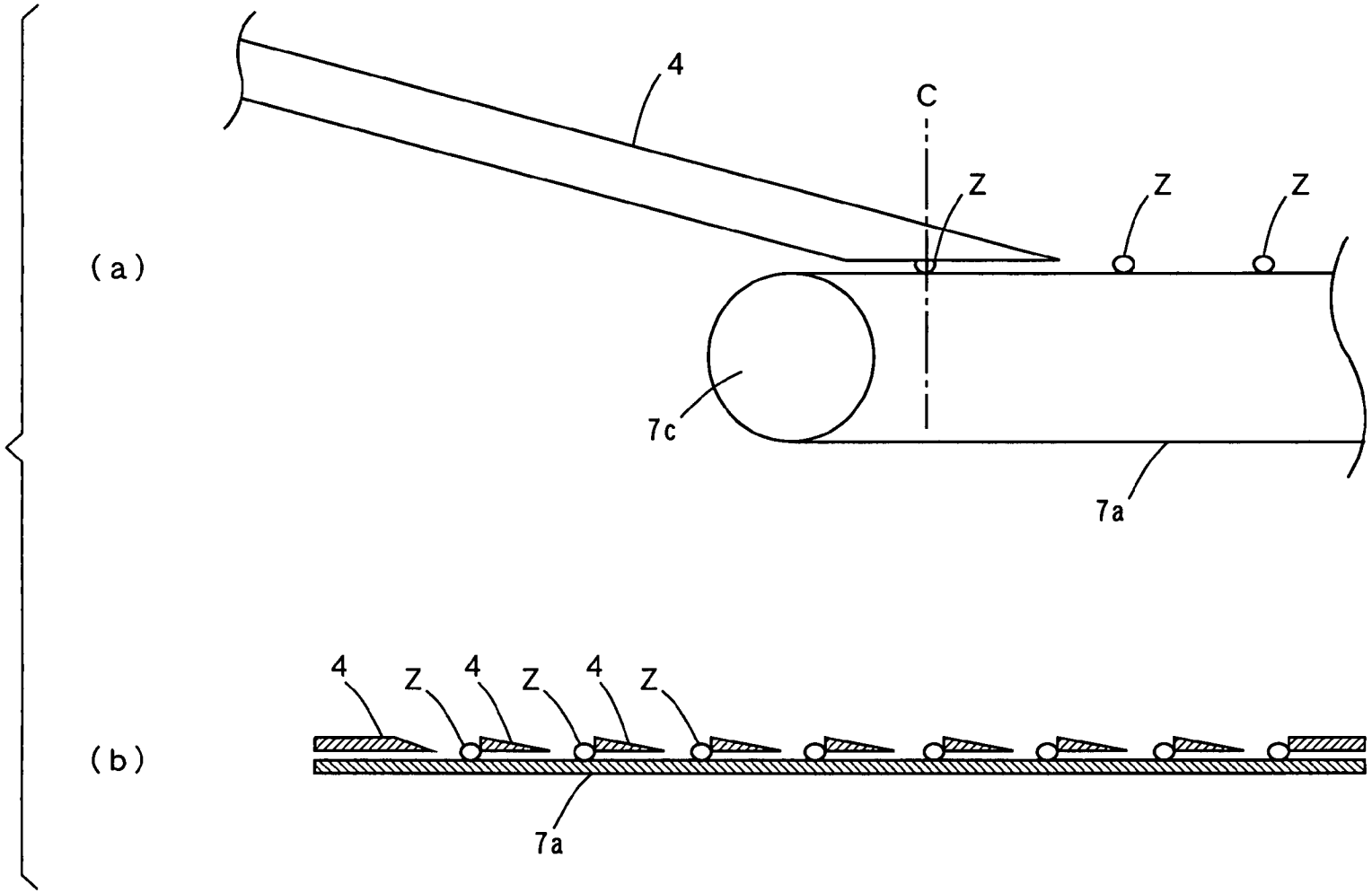
FIG. 4 is a schematic diagram explaining how the seeds are passed on to a belt from the alignment trough.

FIG. 4 is a schematic diagram explaining how the seeds Z are passed on to the belt 7*a* from the alignment trough 4. FIG. 4(*a*) is a schematic side view of the alignment trough 4 and the belt 7*a*; and FIG. 4(*b*) is a schematic cross-sectional view of a cross section cut along the one-dot chain line C in FIG. 4(*a*) which is viewed from one end toward the other end.

As shown in FIG. 4(*a*), the alignment trough 4 is inclined so that the lower part of the other end of the alignment trough 4 is in parallel with the belt 7*a*. In the present embodiment, the alignment trough 4 is inclined at 10 degrees with respect to the horizontal surface. In addition, there is a gap between the alignment trough 4 and the belt 7*a*.

In the present example, there is a gap of approximately 0.4 mm to 0.5 mm. The height of the seed Z in the present example is, for example, approximately 0.5 mm to 0.6 mm. This prevents the seed Z from entering the gap between the alignment trough 4 and the belt 7*a*.

As a result, the seeds Z are guided by the other end of the alignment trough 4, also after supplied on the belt 7*a*, and the rows of the seeds Z formed by the plurality of grooves 42 are maintained constant.

Figure 5:
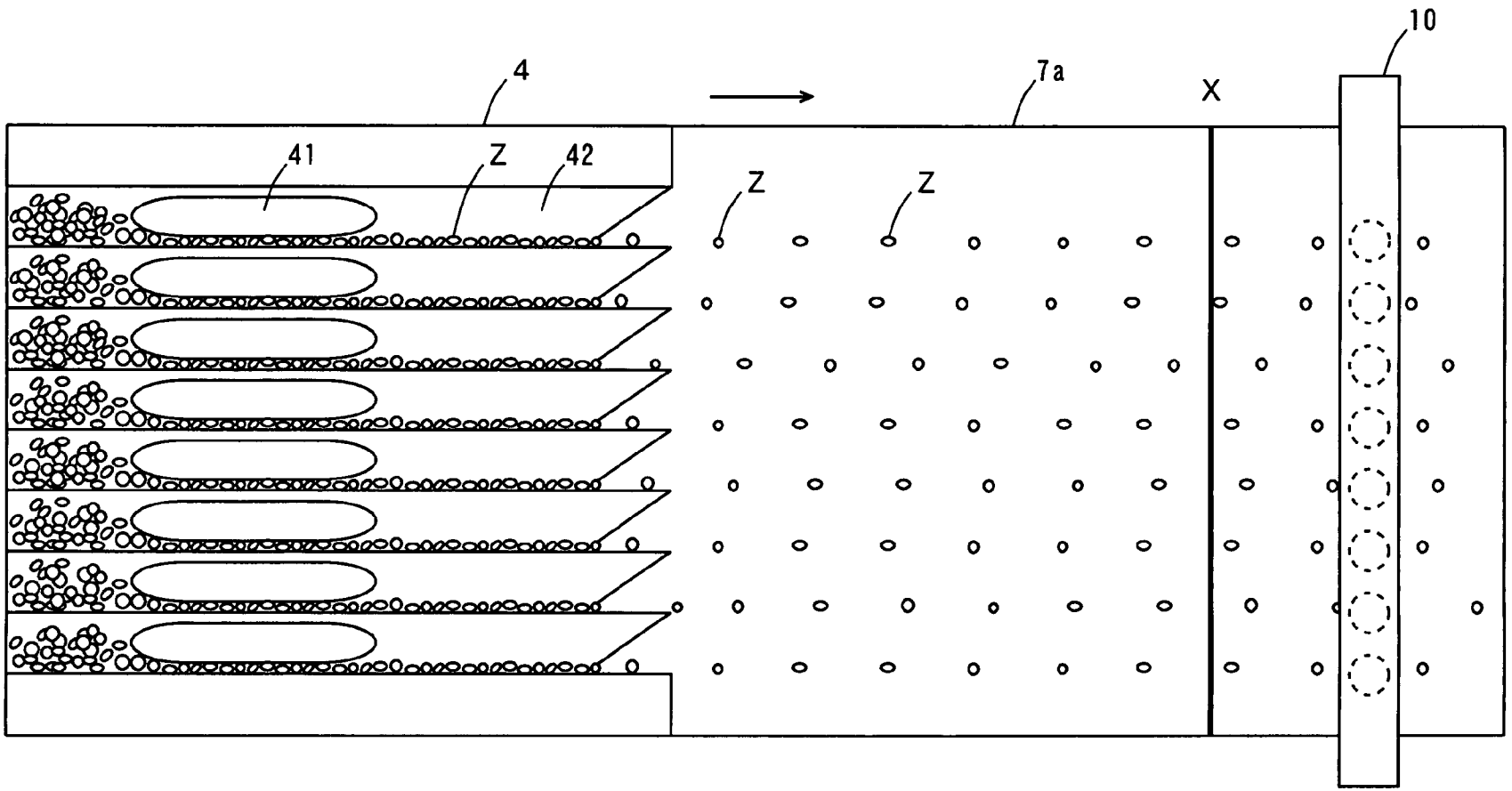
FIG. 5 is a schematic view showing how the seeds supplied to the belt from the alignment trough are being transported.

FIG. 5 is a schematic view showing how the seeds Z supplied to the belt 7*a* from the alignment trough 4 are being transported.

As shown in FIG. 5, the seeds Z supplied to the alignment trough 4 form a row in each of the grooves 42 because of the opening 41, and are supplied to the belt 7*a*.

The seeds Z supplied to the belt 7*a* are transported in the direction of the arrow. A speed at which the belt 7*a* transports the seeds Z is set to a greater value than that at which the alignment trough 4 transports the seeds Z. This makes an interval between the seeds Z being transported on the belt 7*a* greater than an interval between the seeds Z moving on the alignment trough 4. As a result, inspection of each one 6*f* the seeds Z can be reliably performed for each row.

A measurement region X shows a perpendicular direction in the horizontal surface with respect to the transporting direction of the seeds z. The line sensor in the line sensor camera 9 shown in FIG. 1 has 2048 pixels along the direction of the measurement region X. Each pixel in the line sensor measures the average luminance value of a square region of 50 μm×50 μm (hereinafter referred to as one unit) on the measurement region X.

Eight regions where the measurement region X and the rows formed by the seeds Z in the direction of the arrow overlap with each other are hereinafter referred to as processing regions. Each processing region is composed of continuous 50 pixels at a predetermined interval in the measurement region X.

Moreover, the line sensor camera 9 measures a luminance value in the measurement region X at predetermined time intervals. An inspection method of the line sensor camera 9 will be later described in detail.

In the case where the inspected seed Z is determined to be "black" as a result of the inspection by the line sensor camera 9, each one of the seeds Z is individually sucked by the nozzle 10*a* of the nozzle device 10. Such inspection of each one of the seeds Z makes it possible to sort the seeds Z with higher accuracy. Moreover, simultaneous inspection of the plurality of rows of the seeds Z is possible as described in FIG. 2, thereby reducing the time required for the inspection.

Figure 6:
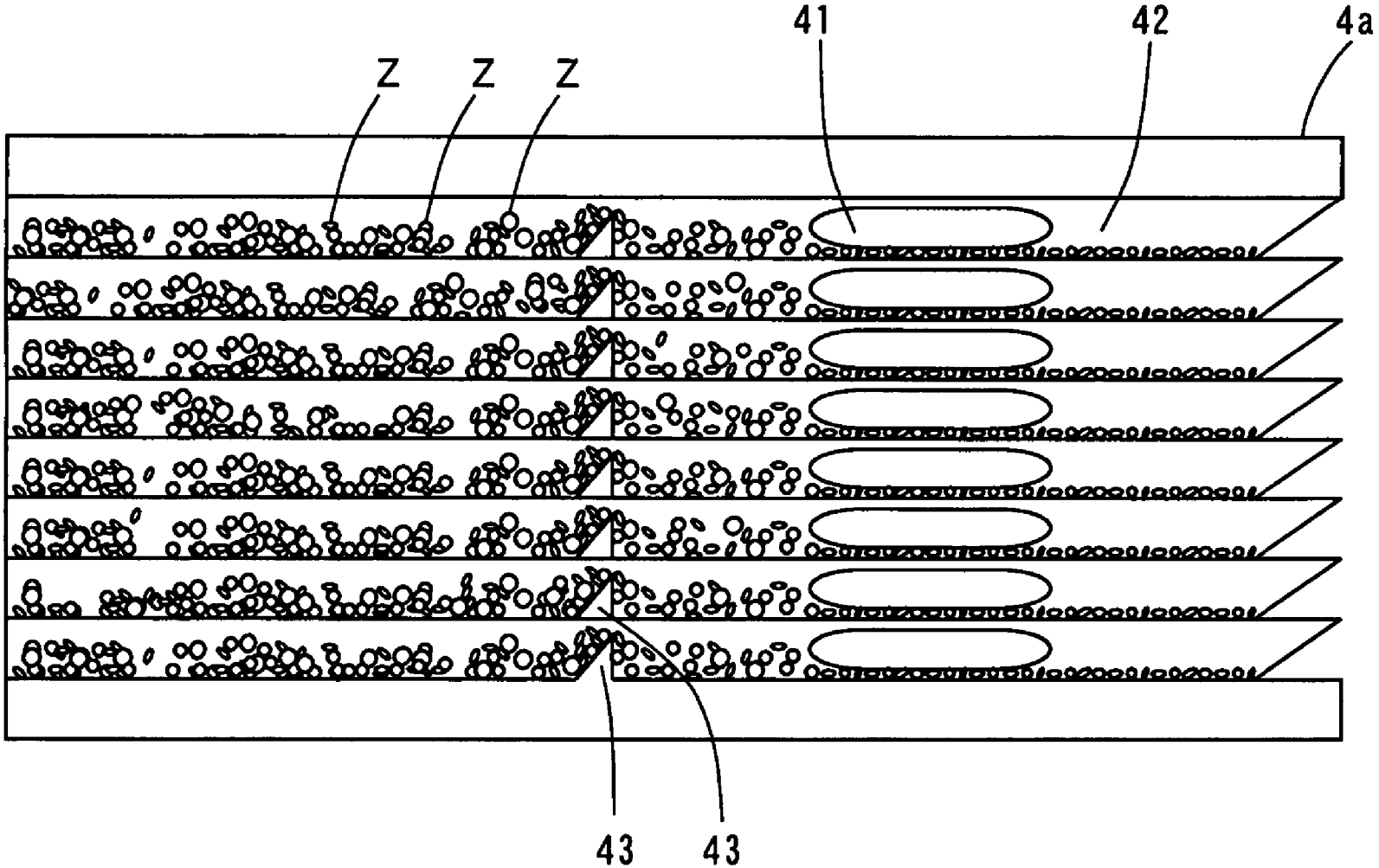
FIG. 6 is a plan view showing another alignment trough.

FIG. 6 is a plan view showing another alignment trough 4*a*.

As shown in FIG. 6, the alignment trough 4*a* differs from the alignment trough 4 shown in FIG. 3 in that it is provided with a blockage 43 of plane triangle on the way of each groove 42. Although the seed Z that has reached the blockage 43 is temporarily blocked by the blockage 43, it climbs over the blockage 43 because of pressure from the following seeds Z.

It is noted here that the seed Z has an infinite number of cilia around its outer periphery, and it is hard to separate overlapping seeds Z from one another. However, a group of the plurality of seeds Z temporarily blocked by the blockage 43 are, when climbing over the blockage 43, separated from one another because of pressure from the following seeds Z. The extra seeds Z are therefore reliably collected through the openings 41.

Figure 7:
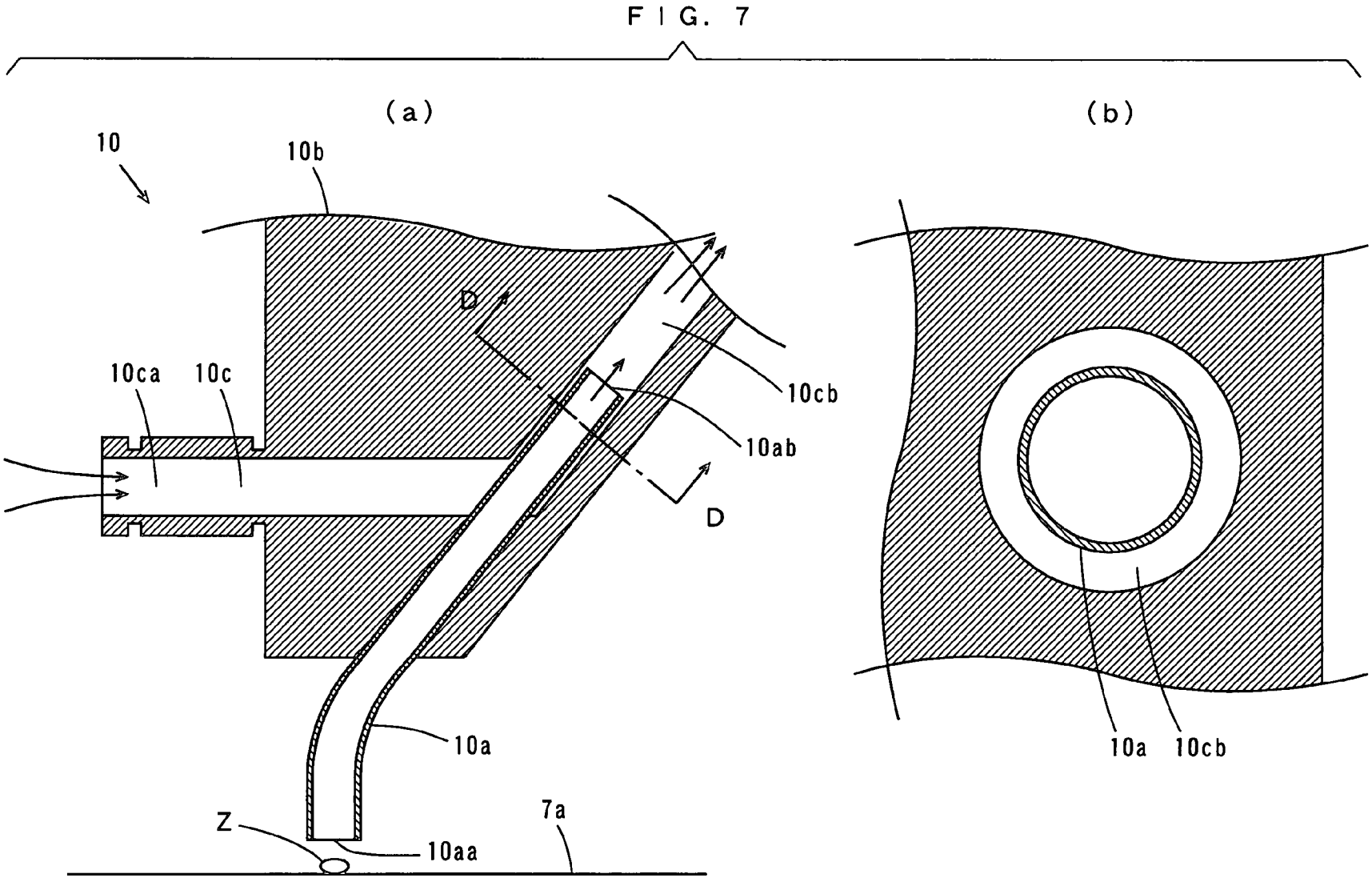
FIG. 7 is a schematic view for explaining a nozzle device.

FIG. 7 is a schematic view for explaining the nozzle device 10. FIG. 7(*a*) is a schematic cross-sectional view of the nozzle device 10, and FIG. 7(*b*) is a D—D line cross-sectional view of FIG. 7(*a*).

As shown in FIG. 7(*a*), the nozzle device 10*a* includes a nozzle 10*a* and a main body 10*b*. A compressed gas path 10*c* is formed in the main body 10*b*. The compressed gas path 10*c* comprises a compressed air introduction part 10*ca* and a compressed air discharge part 10*cb*. The compressed air discharge part 10*cb* is inclined with respect to the horizontal surface. In the present example, the compressed air discharge part 10*cb* is inclined at 45 degrees with respect to the horizontal surface.

The nozzle 10*a* is a cross-sectional annular round pipe composed of stainless. A lower end of the nozzle 10*a* is provided with a seed suction spout 10*aa*, whereas an upper end thereof is provided with a seed discharge spout 10*ab*. An upper part of the nozzle 10*a* is inserted to form a concentric circle with the compressed air discharge part 10*cb* of the compressed air path 10*c*. The nozzle 10*a* bends at its lower end so that the lower end of the nozzle 10*a* becomes vertical with respect to the belt 7*a*.

As shown in FIG. 7(*b*), since the compressed air discharge part 10*cb* has a larger diameter than that of the nozzle 10*a*, there is a gap between the nozzle 10*a* and the compressed air discharge part 10*cb*. In the present example, a difference between the diameters of the nozzle 10*a* and the compressed air discharge part 10*cb* is approximately 0.5 mm.

The compressed air stored in the tank within the pneumatic device 21 shown in FIG. 1 is supplied to the compressed air introduction part 10*ca*. The compressed air supplied into the compressed air introduction part 10*ca* passes via the compressed air discharge part 10*cb* to be discharged toward the accepted article guide 11.

In this case, the speed of the compressed air remarkably increases in the gap between the nozzle 10*a* and the compressed air discharge part 10*cb*. This causes a negative pressure at an upper end of the nozzle 10*a* to cause gas flow from a lower end toward the upper end. As a result, the seeds Z transported on the belt 7*a* are sucked by the seed suction spout 10*aa* to pass via the seed discharge spout 10*ab* and compressed air discharge part 10*cb* and to be discharged to the accepted article guide 11 shown in FIG. 1.

The upper part of the nozzle 10*a* and the compressed air discharge part 10*cb* having an inclination of 45 degrees with respect to the horizontal surface makes it difficult for the seeds Z to fall. Accordingly, the seeds Z can be efficiently sucked.

In addition, the lower end of the nozzle 10*a* vertically provided with respect to the belt 7*a* enables minimization of the cross sectional area of the seed suck spout 10*aa*. This avoids reduction in the suction force of the nozzle 10*a* without distribution of the suction force. Moreover, it prevents objects other than the seeds Z from being sucked.

Figure 8:
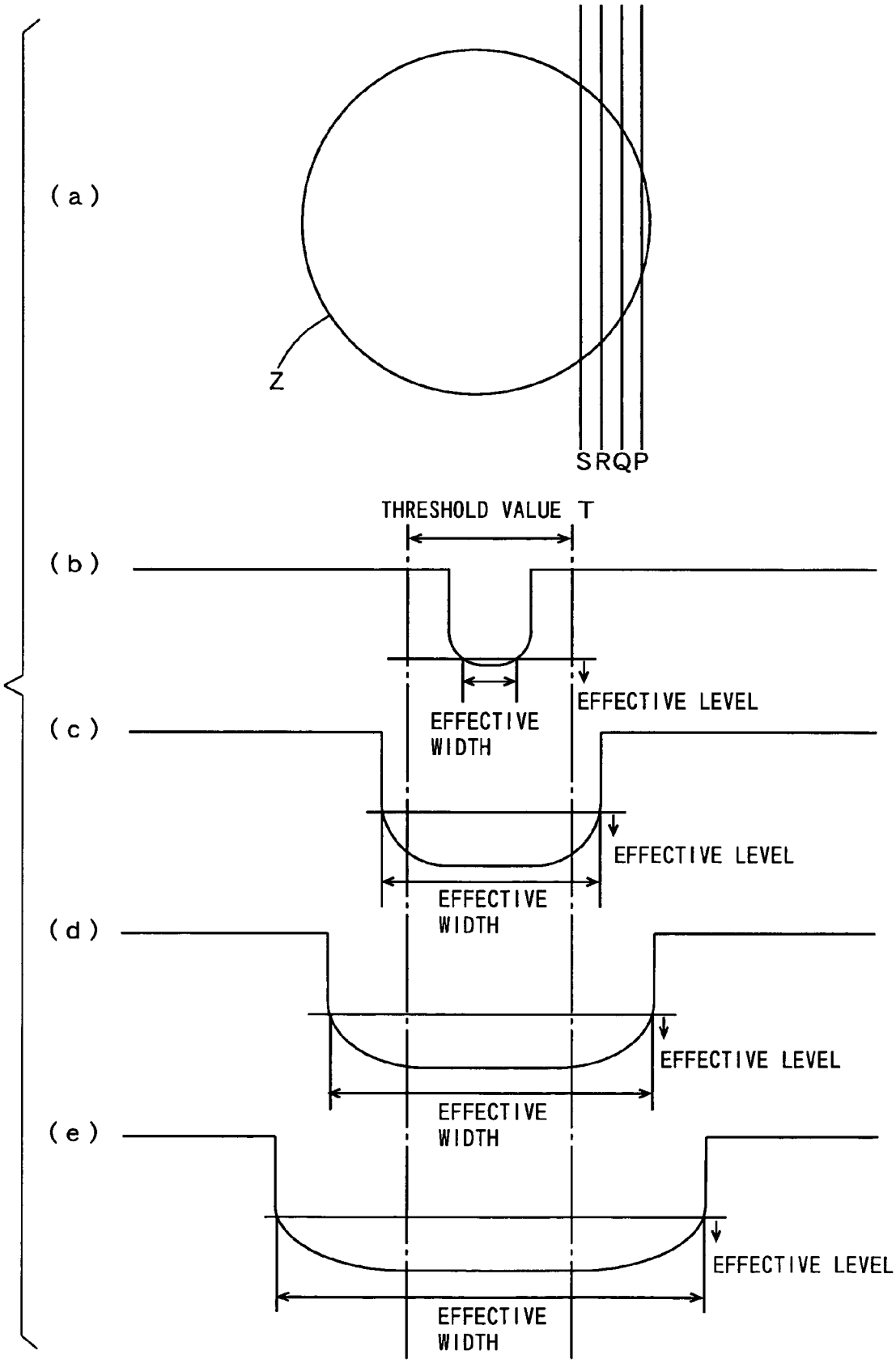
FIG. 8 is a diagram for explaining inspection of the seeds performed by the line sensor camera shown in FIG. 1.

FIG. 8 is a diagram for explaining inspection of the seeds performed by the line sensor camera 9 shown in FIG. 1.

Since the inspection conveyor 7 is white, a luminance value on the measurement region X shown in FIG. 5 is approximately that of the maximum level when there are no seeds supplied on the inspection conveyor 7. Since the seeds Z are either brown or black, the luminance value obtained in the part where the measurement region X and the seed Z overlap with each other is abruptly reduced.

Suppose now that luminance values are measured when the position of the measurement region X relatively moves in accordance with the movement of the belt 7*a* in four lines, from lines P to S as shown in FIG. 8(*a*).

FIGS. 8(*b*) to (*e*) are waveform diagrams showing luminance values obtained in the lines P to S shown in FIG. 8(*a*), respectively. The abscissa in each of FIGS. 8(*b*) to (*e*) represents the position on the measurement region X shown in FIG. 4, whereas the ordinates represents a luminance value.

As shown in FIG. 8(*b*), the luminance value is abruptly reduced in the part where the measurement region X and the seed Z overlap with each other. The seed Z in the present embodiment is either brown or black, and the luminance value to be measured is accordingly low. Therefore, in order to enhance accuracy of inspection by excluding the objects other than the seeds Z from the inspection, only the objects having luminance values of not more than a certain luminance level (hereinafter referred to as an effective level) are targeted for the inspection. A width in the direction of the line having luminance values not more than the effective level is referred to as an effective width.

Since the width where the seed Z and the measurement region X overlap with each other gradually increases as the seed Z is transported by the belt 7*a*, the effective width also increases as shown in FIGS. 8(*c*) to (*e*).

In the case where the effective width is greater than a threshold value T in three consecutive lines, it is determined that the seeds Z are being transported by the belt 7*a*. On the contrary, in the case where the effective width is smaller than the threshold value T, it is determined that the seeds Z are not being transported by the belt 7*a*. Contaminants and the like having a smaller width than that of the seed Z are accordingly not the objects of the inspection. As a result, accuracy of inspection is enhanced.

In the case where the effective width is greater than the threshold value T in three consecutive lines, an average luminance value for each one unit within each processing region is accumulated to form a frequency distribution of average luminance values. This frequency distribution is being formed until the effective width becomes smaller than the threshold value T. In this frequency distribution, a luminance value with the highest frequency is referred to as a most frequent luminance value. It is determined whether this most frequent luminance value is greater or smaller than a preset value (hereinafter referred to as a reference value).

In the case where the most frequent luminance value is smaller than the reference value, the color of the seed Z is determined to be black, whereas the most frequent luminance value is not smaller than the reference value, the color of the seed Z is determined to be brown.

In the case where the color of the seed Z is determined to be black, a timer in the control unit 22 is started up, and the nozzle 10*a* corresponding to the row of the seed Z determined to be black automatically performs suction operation after the elapse of a certain period of time. The seed Z that has passed the measurement region X is transported right under the nozzle 10*a*, after, for example, 340 milliseconds, by the operation of the belt 7*a*, to be sucked by the nozzle 10*a*. In the case where the color of the seed Z is determined to be brown, the timer in the control unit 22 is not started up, and the seed Z is collected in the rejected article collection vessel 19 via the rejected article guide 12.

Figure 9:
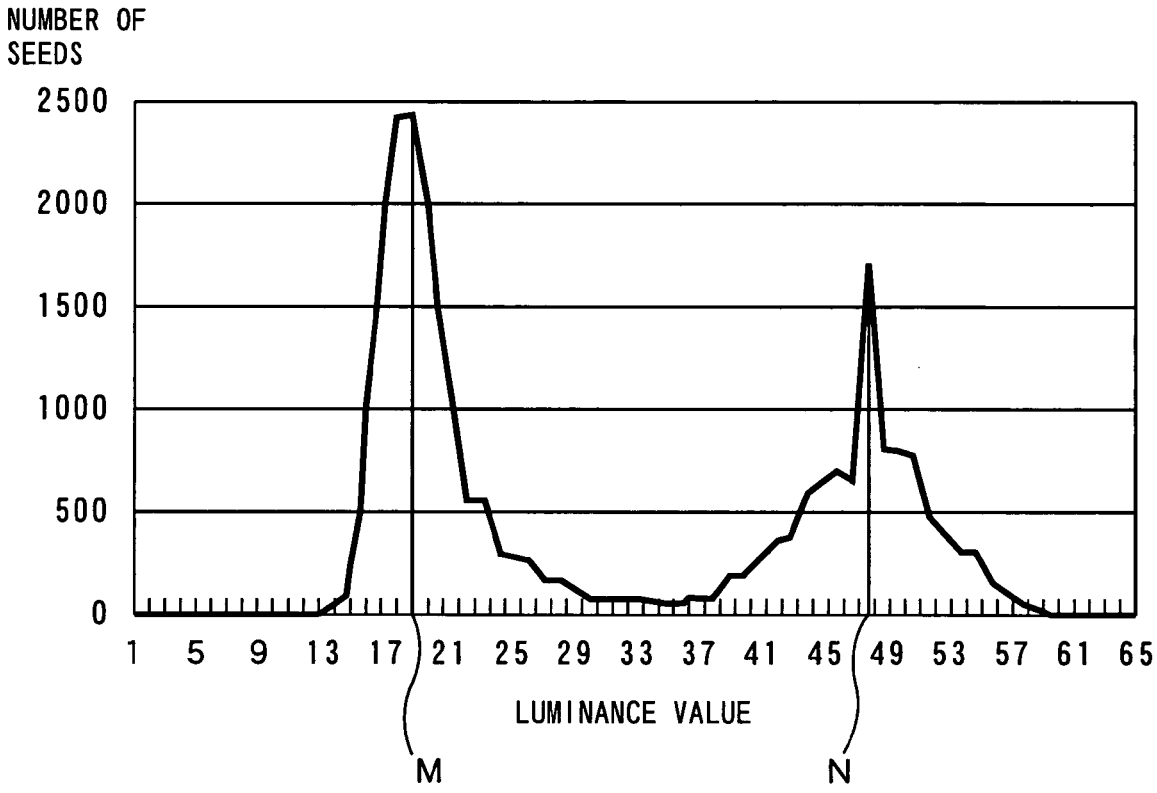
FIG. 9 is a frequency distribution obtained by gathering most frequent luminance values of several thousands of the seeds.

FIG. 9 is a frequency distribution obtained by gathering the most frequent luminance values of several thousands of the seeds Z.

As shown in FIG. 9, the frequency distribution of the most frequent luminance values of several thousands of the seeds Z has a shape of two mountains: the mountain of lower luminance values represents the distribution of the most frequent luminance values of the black seeds Z, whereas the mountain of higher luminance values represents the distribution of the most frequent luminance values of the brown seeds Z.

When the luminance value having a largest number in the distribution of the most frequent luminance values of the black seeds Z is defined as a luminance value M, and the luminance value having a largest number in the distribution of the most frequent luminance values of the brown seeds Z is defined as a luminance value N, a reference value is expressed by the following equation (1):

$$\text{reference value}=(M+N)/2 \quad (1)$$

The reference value is determined by measuring in advance the most frequent luminance values of several hundreds to thousands of the seeds Z, before starting to sort the seeds Z.

Figure 10:
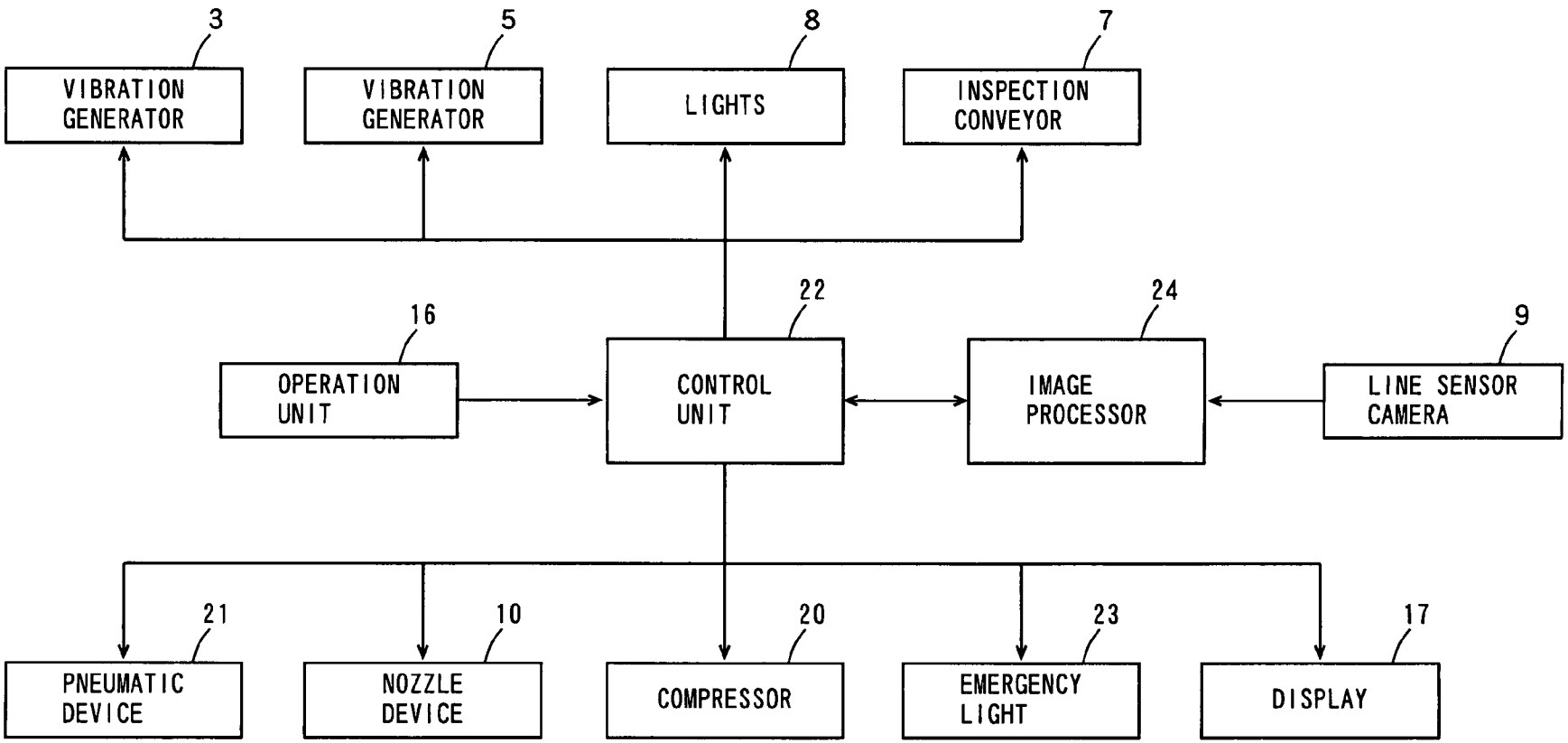
FIG. 10 is a block diagram showing the control system of a sorting apparatus.

FIG. 10 is a block diagram showing the control system of the sorting apparatus 100.

An image processor 24 receives an output signal from the line sensor camera 9 and an instruction signal supplied from the control unit 22. The control unit 22 receives an instruction signal supplied from the operation unit 16 and a luminance value for one unit calculated by the image processor 24. In addition, the control unit 22 controls the operations of the vibration generators 3, 5, lights 8, inspection conveyor 7, pneumatic device 21, nozzle device 10, compressor 20, emergency light 23, and display 17 based on the instruction signal supplied from the operation unit 16 and the luminance value supplied from the image processor 24.

Figure 11:
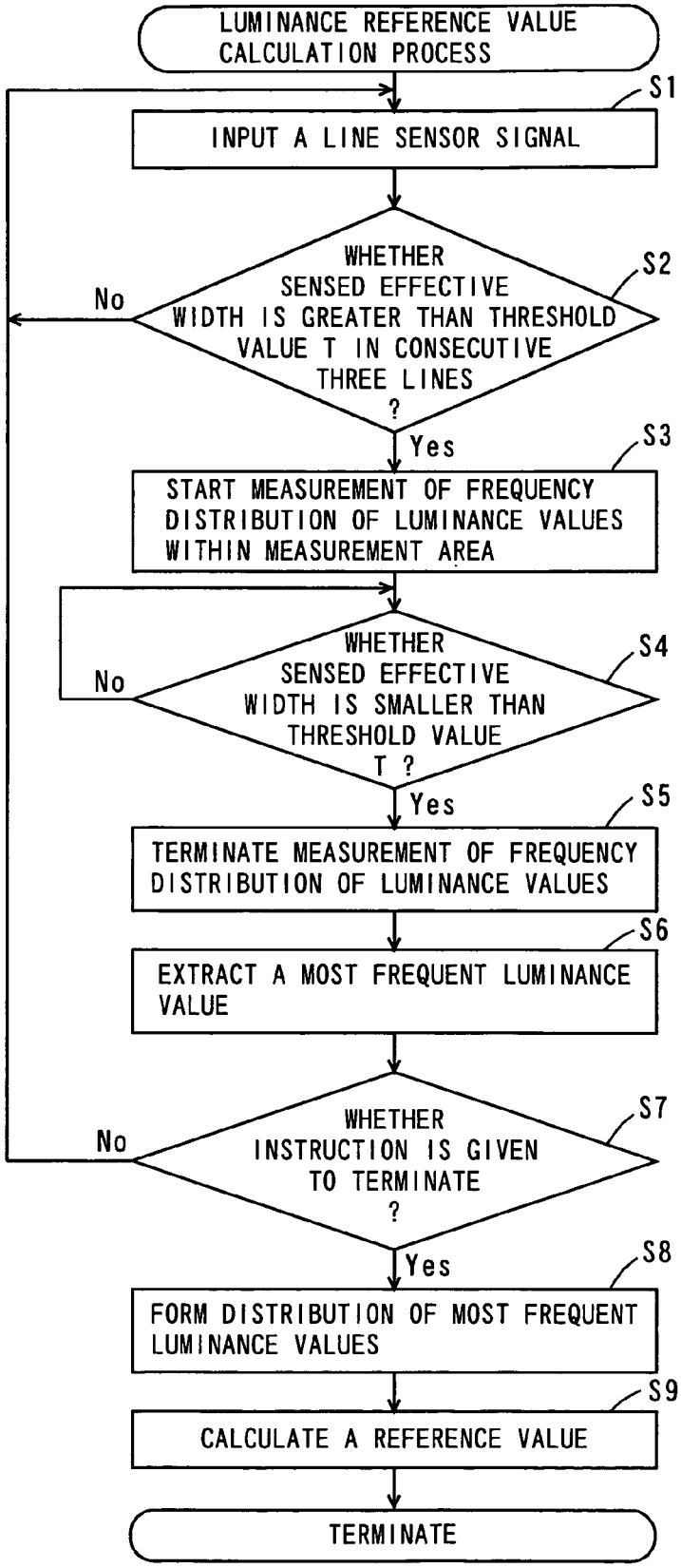
FIG. 11 is a flowchart showing a reference value calculation process performed by a control unit.

FIG. 11 is a flowchart showing a luminance reference value calculation process performed by the control unit 22. The flowchart shown in FIG. 11 will be now described by referring to FIGS. 9 and 10.

As shown in FIG. 11, the control unit 22 receives from the image processor 24 a signal representing an average luminance value for each one unit within the measurement region (Step S1).

The control unit 22 then determines whether a sensed effective width of the seed Z is greater than the threshold value T in three consecutive lines (Step S2). The control unit 22 repeats the operation of Step S1 when it does not determine that the sensed effective width of the seed Z is greater than the threshold value T in three consecutive lines.

At Step S2, the control unit 22 starts formation of a frequency distribution of the average luminance values for one unit within the measurement region when it determines that the sensed effective width of the seed Z is greater than the threshold value T in three consecutive lines (Step S3).

The control unit 22 then determines whether the sensed effective width of the seed Z is smaller than the threshold value T (Step S4). The control unit 22 continues formation of the average luminance values for one unit within the measurement region when it determines that the sensed effective width of the seed Z is not smaller than the threshold value T.

At Step 4, the control unit 22 terminates formation of the frequency distribution of the average luminance values when it determines that the sensed effective width of the seed Z is smaller than the threshold value T (Step S5). The frequency distribution of the average luminance values is consequently formed.

The control unit 22 then extracts the most frequent luminance value in the formed frequency distribution of the luminance values (Step S6).

After that, the control unit 22 determines whether it is instructed to terminate the operation (Step S7). The control unit 22 returns to Step S1 to repeat the processes of Step S1 through Step S7 when it is not instructed to terminate the operation.

In the case where it is instructed to terminate the operation at Step S7, the control unit 22 forms the frequency distribution of the most frequent luminance values shown in FIG. 9 (Step S8). The control unit 22 subsequently calculates a reference value based on the frequency distribution of the most frequent luminance values shown in FIG. 9 (Step S9).

Figure 12:
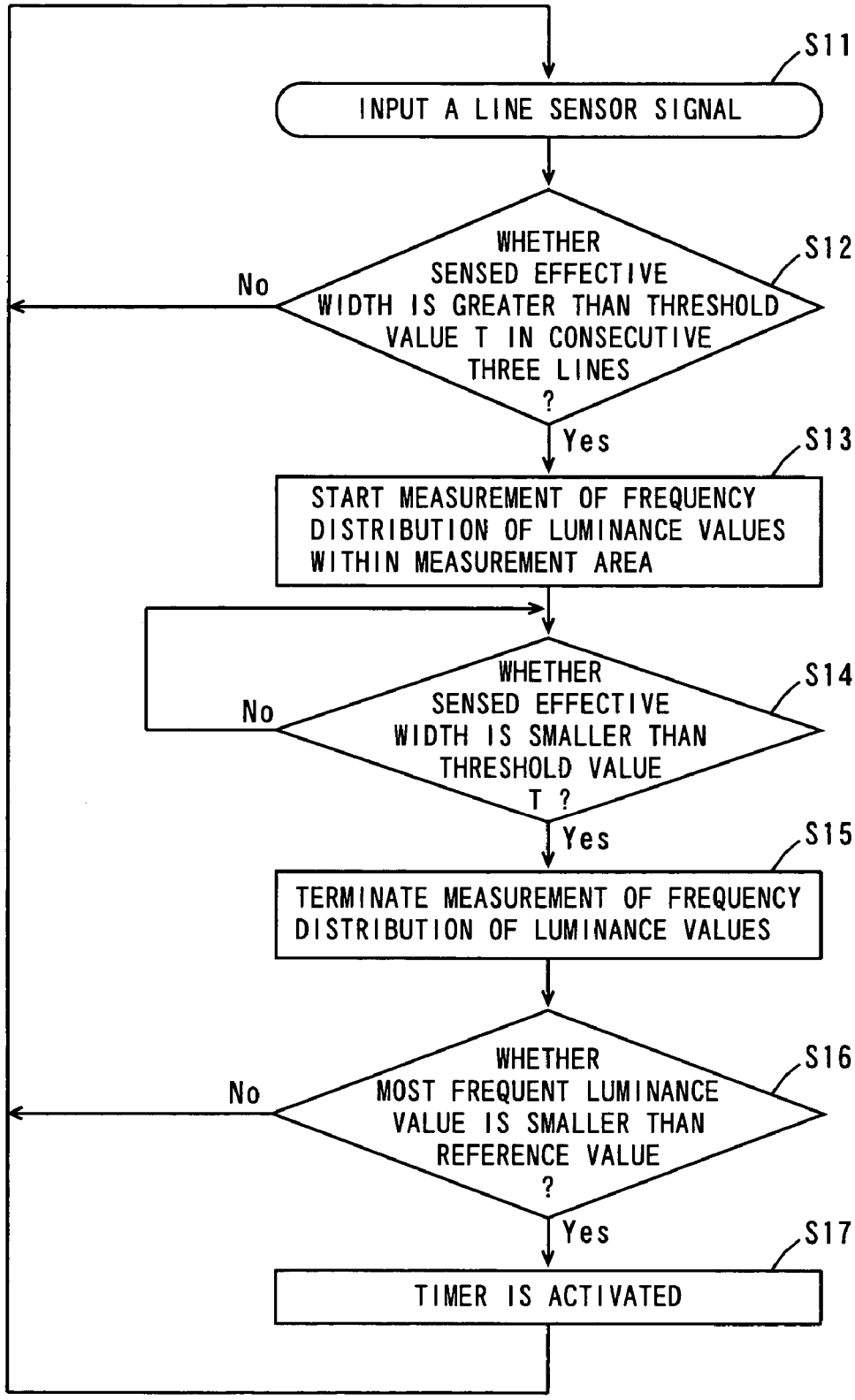
FIG. 12 is a flowchart showing one example of sorting operation performed by the sorting apparatus.

FIG. 12 is a flowchart showing one example of sorting operation performed by the sorting apparatus 100. The sorting operation shown in FIG. 12 will be now described by referring to FIG. 10.

The control unit 22 receives from the image processor 24 a signal representing an average luminance value for one unit within the measurement region (Step S11). The control unit 22 subsequently determines whether a sensed effective width of the seed Z is greater than the threshold value T in three consecutive lines (Step S12).

The control unit 22 repeats the operation of Step S11 when it does not determine that the sensed effective width of the seed Z is greater than the threshold value T in three consecutive lines. At Step S12, the control unit 22 starts formation of a frequency distribution of the average luminance values for each one unit within the measurement region when it determines that the sensed effective width of the seed Z is greater than the threshold value T in three consecutive lines (Step S13).

The control unit 22 subsequently determines whether the sensed effective width is smaller than the threshold value T (Step S14). The control unit 22 continues formation of the frequency distribution of the average luminance values for each one unit within the measurement region when it determines that the sensed effective width of the seed Z is not smaller than the threshold value T.

At Step S14, the control unit 22 terminates formation of the frequency distribution of the average luminance values when it determines that the sensed effective width of the seed Z is smaller than the threshold value T (Step S15).

The control unit 22 subsequently determines whether the most frequent luminance value of the seed Z is smaller than the reference value (Step S16). The control unit 22 starts up the timer within the control unit 22 when it determines that the most frequent luminance value of the seed Z is smaller than the reference value (Step S17).

At Step S16, the control unit 22 repeats the operations from Step S11 when it determines that the most frequent luminance value is not smaller than the reference value.

As described above, since the line camera sensor 9 inspects both the size and color of an inspected object to sort the seeds Z, in the sorting apparatus 100 according to the present embodiment, the seeds Z are reliably sorted.

In the present embodiment, the seed Z corresponds to an article to be sorted; the alignment trough 4 and vibration generator 5 correspond to an alignment apparatus; the inspection conveyor corresponds to a transport apparatus; the line sensor camera 9 corresponds to a line sensor; the nozzle 10*a* corresponds to a suction device; the nozzle 10 corresponds to a suction device; the controller 22 corresponds to a controller and a determiner; the vibration generator 5 corresponds to a vibration generation device; the opening 41 corresponds to an opening; the overflow recovery device 6 corresponds to a recovery device.

Moreover, in the present embodiment, the compressed air path 10*c* corresponds to a gas path and a gas flow-in path; the nozzle 10*a* corresponds to a tubular nozzle; the seed suction spout 10*aa* corresponds to one opening end; the seed discharge spout 10*ab* corresponds to another opening end; the pneumatic device 21 corresponds to a gas creating device; the belt 7*a* corresponds to a supporting surface; and the seed Z corresponds to a target object.

Another embodiment of the present invention will be hereinafter described by referring to the drawings.

Figure 13:
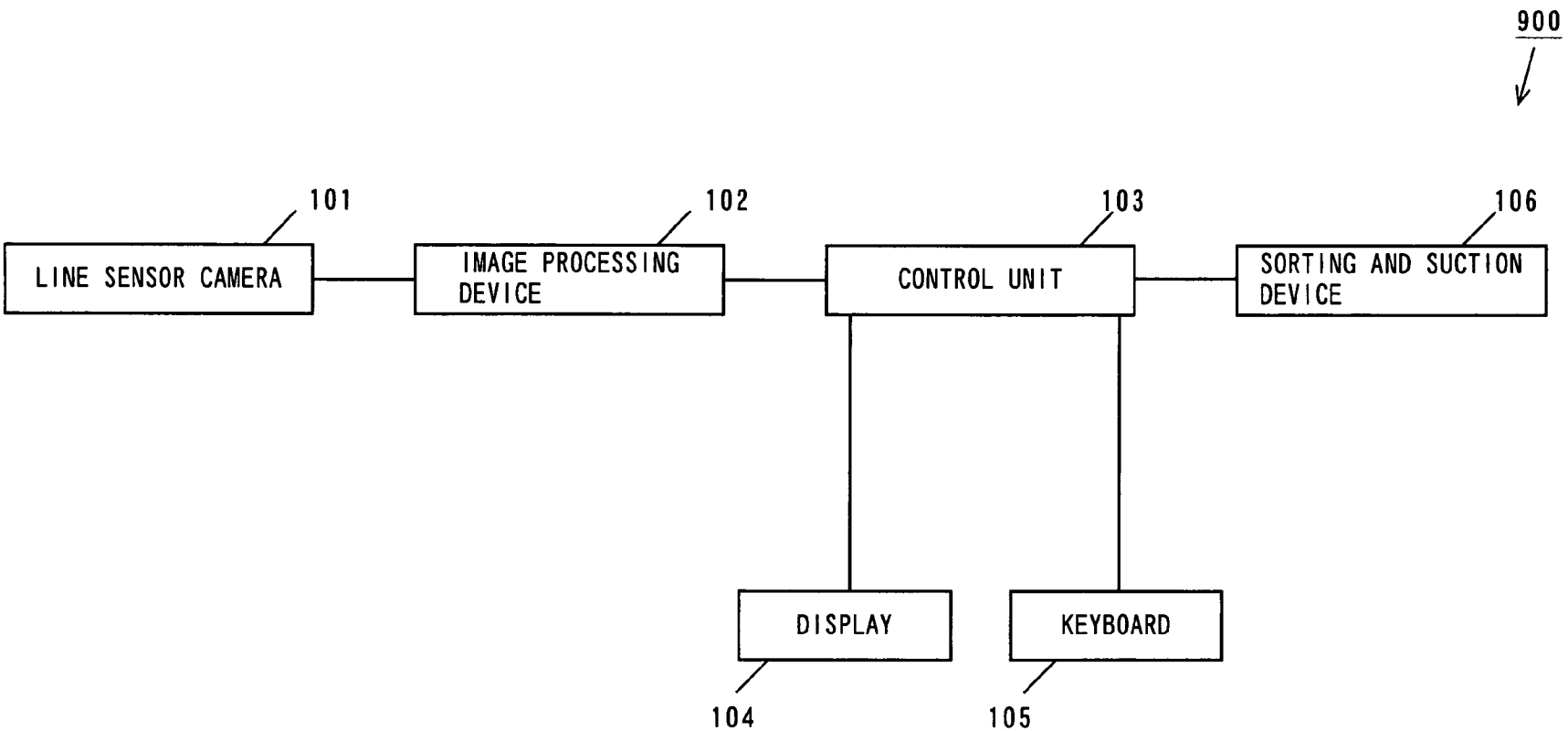
FIG. 13 is a block diagram showing the configuration of a seed sorting apparatus according to the present embodiment.

FIG. 13 is a block diagram showing the configuration of a seed sorting apparatus according to the present embodiment.

As shown in FIG. 13, a seed sorting apparatus 900 includes a line sensor camera 101, an image processing device 102, a control unit 103, a display 104, a keyboard 105, and a sorting and suction device 106. As a sorting and suction device 106, the nozzle device 10 shown in FIG. 10, for example, may be used.

The line sensor camera 101, which mainly includes a CCD (Charge-Coupled Device) line sensor and lenses, photographs seeds on a belt conveyor (not shown) to output their output luminance data to the image processing device 102. Moreover, the line sensor camera 101 is provided to photograph a linear region perpendicular to a moving direction of the belt conveyor. The output luminance data from the line sensor camera 101 represents a luminance value of the photographed linear region.

The line sensor camera 101 has 2048 of pixels along the above-described linear region. Each of the pixels in the line sensor camera 101 measures an average luminance value of a square region of 50 μm×50 μm in the above-described linear region.

The image processing device 102 processes the output luminance data from the line sensor camera 101. The control unit 103 comprises, for example, a personal computer, and controls the image processing device 102 and sorting and suction device 106.

The control unit 103 is connected to the display 104 and keyboard 105. The sorting and suction device 106 comprises nozzles, and performs sorting by sucking the seeds on the belt conveyor in response to an instruction signal from the control unit 103.

Figure 14:
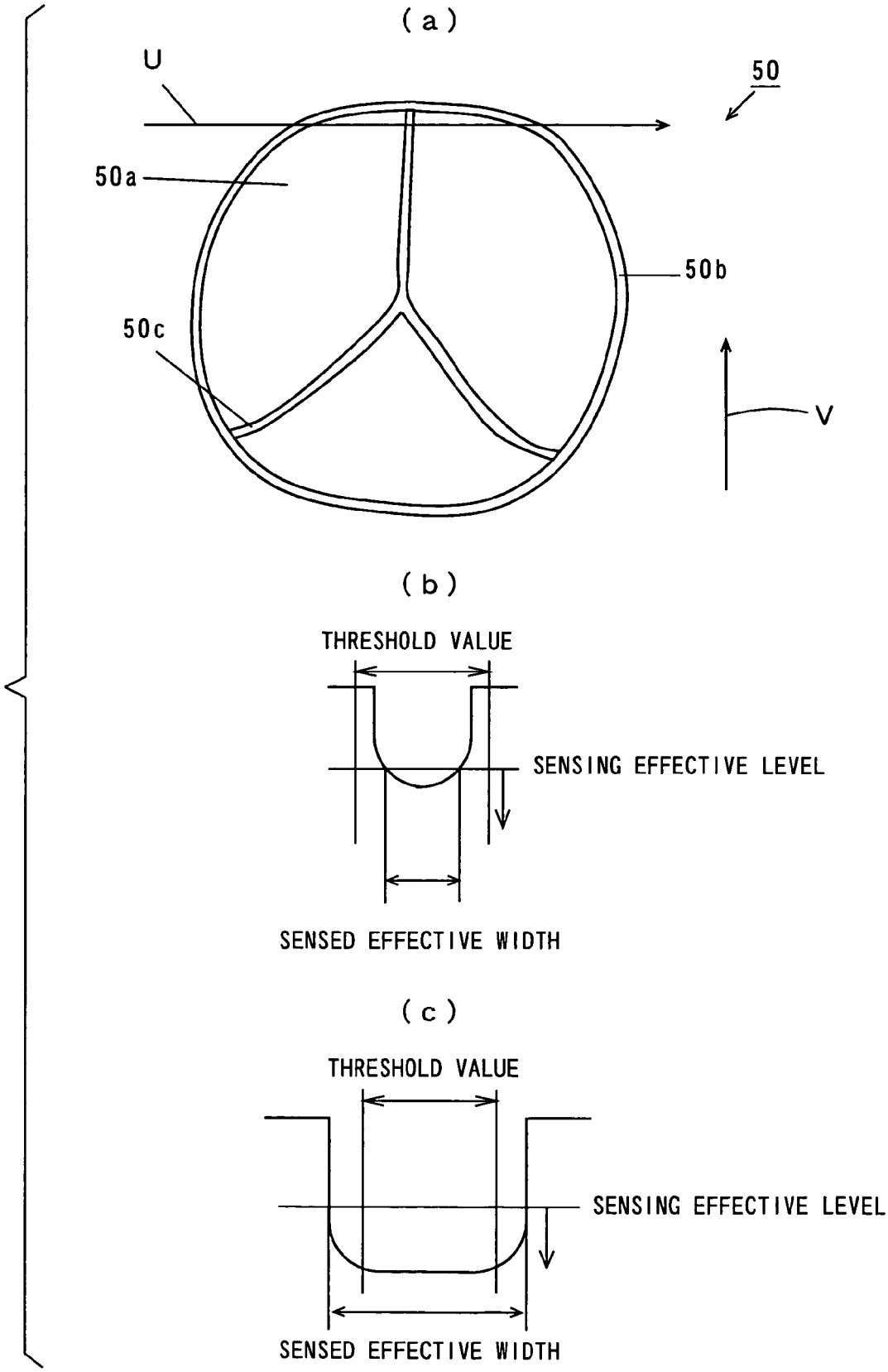
FIG. 14 is a diagram showing a method of detecting the seeds performed by the line sensor camera shown in FIG. 13.

FIG. 14 is a diagram showing a method of detecting the seeds performed by the line sensor camera 101 shown in FIG. 13. FIG. 14(*a*) is a plan view showing one example of the image of the seed, and FIGS. 14(*b*), (*c*) are waveform diagrams showing the output luminance data from the line sensor camera 101, respectively. In FIGS. 14(*b*), (*c*), the abscissa represents time, whereas the ordinate represents luminance value.

As shown in FIG. 14(*a*), an outer peripheral part 50*b* and a string part 50*c* have higher luminance values than a surface 50*a* in the image of a seed 50. The surface 50*a* herein represents a region of the seed 50 excluding the outer peripheral part 50*b* and string part 50*c*.

In the present embodiment, luminance values of the images input to the image processing device 102 from the line sensor camera 101 which are not more than a preset luminance value are extracted to form a distribution frequency of the extracted luminance values. That is, the frequency distribution of luminance values is formed at a region excluding the outer peripheral part 50*b*, string part 50*c*, and surrounding of the seed 50 in the image of the seed 50.

The seed 50 is scanned in the direction of the arrow U by the line sensor camera 101. In the present embodiment, the scanning process is repeatedly performed by the line sensor camera 101 with the seed 50 moving to the direction of the arrow V. The seed 50 is accordingly scanned from one end to the other end in the direction of the arrow V, for approximately 50 lines. In this case, waveforms as shown in FIGS. 14(*b*), (*c*) are obtained by the control unit 103 for a scanning of each line.

Now, the width of a region having a luminance value not more than a preset sensing effective level will be defined as a sensed effective width.

As shown in FIG. 14(*b*), when the sensed effective width is smaller than a preset threshold value, the control unit 103 determines that the seed 50 is not passing below the line sensor camera 101.

Moreover, as shown in FIG. 14(*c*), when the sensed effective width is greater than the threshold value in three consecutive lines, the control unit 103 determines whether the seed 50 is passing below the line sensor camera 101.

Figure 15:
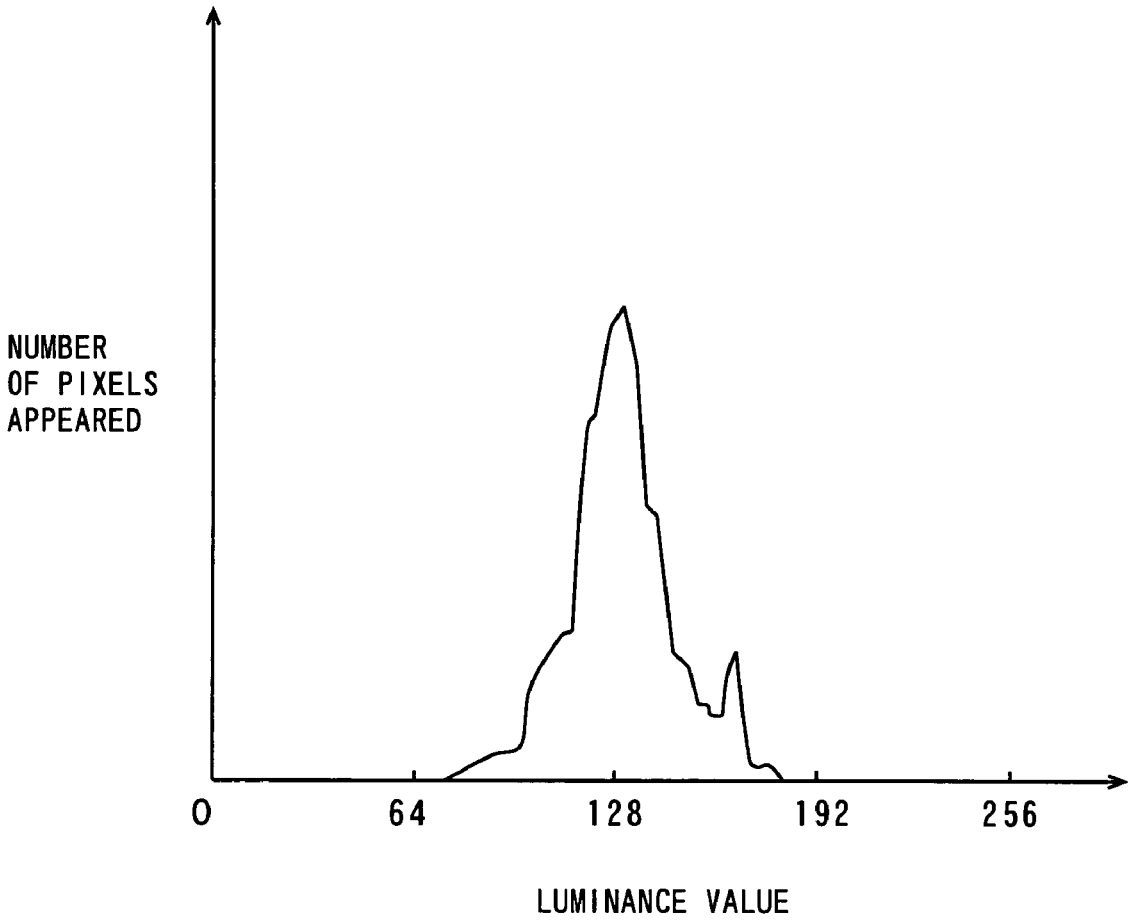
FIG. 15 is a schematic diagram showing one example of a frequency distribution of luminance values of a seed.

FIG. 15 is a schematic diagram showing one example of a frequency distribution of the luminance values of the seed 50. As shown in FIG. 15, the abscissa represents luminance value, whereas the ordinate represents the number of appeared pixels.

The frequency distribution of the luminance values of the seed 50 is formed by the control unit 103 with respect to the region of an image having a luminance value not more than a preset luminance value. The luminance value with a maximum number of appeared pixels is herein defined as a most frequent luminance value.

In the present embodiment, two kinds of the seeds 50 are sorted by comparing the most frequent luminance values with a preset luminance reference value.

Figure 16:
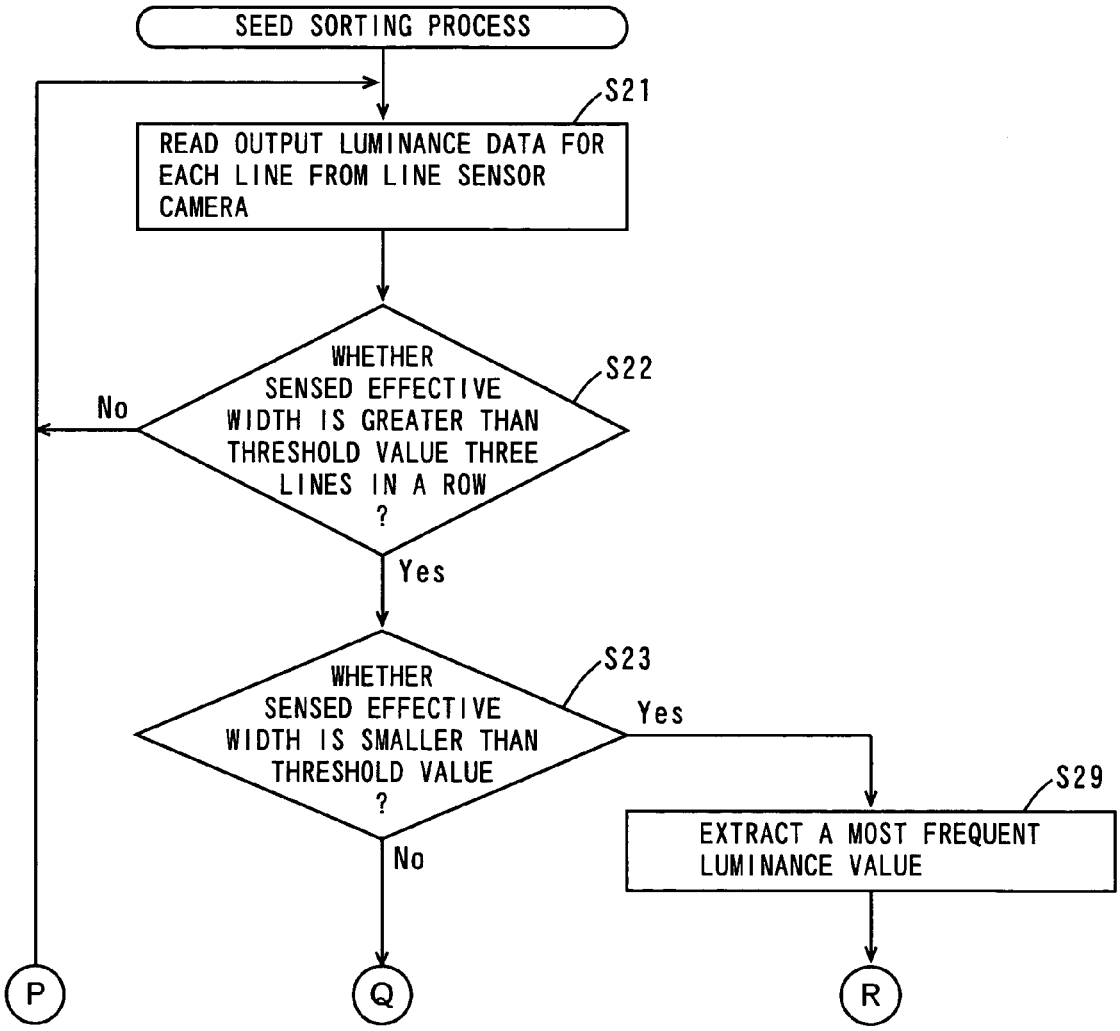
FIG. 16 is a flowchart showing a seed-sorting process performed by the control unit.
Figure 17:
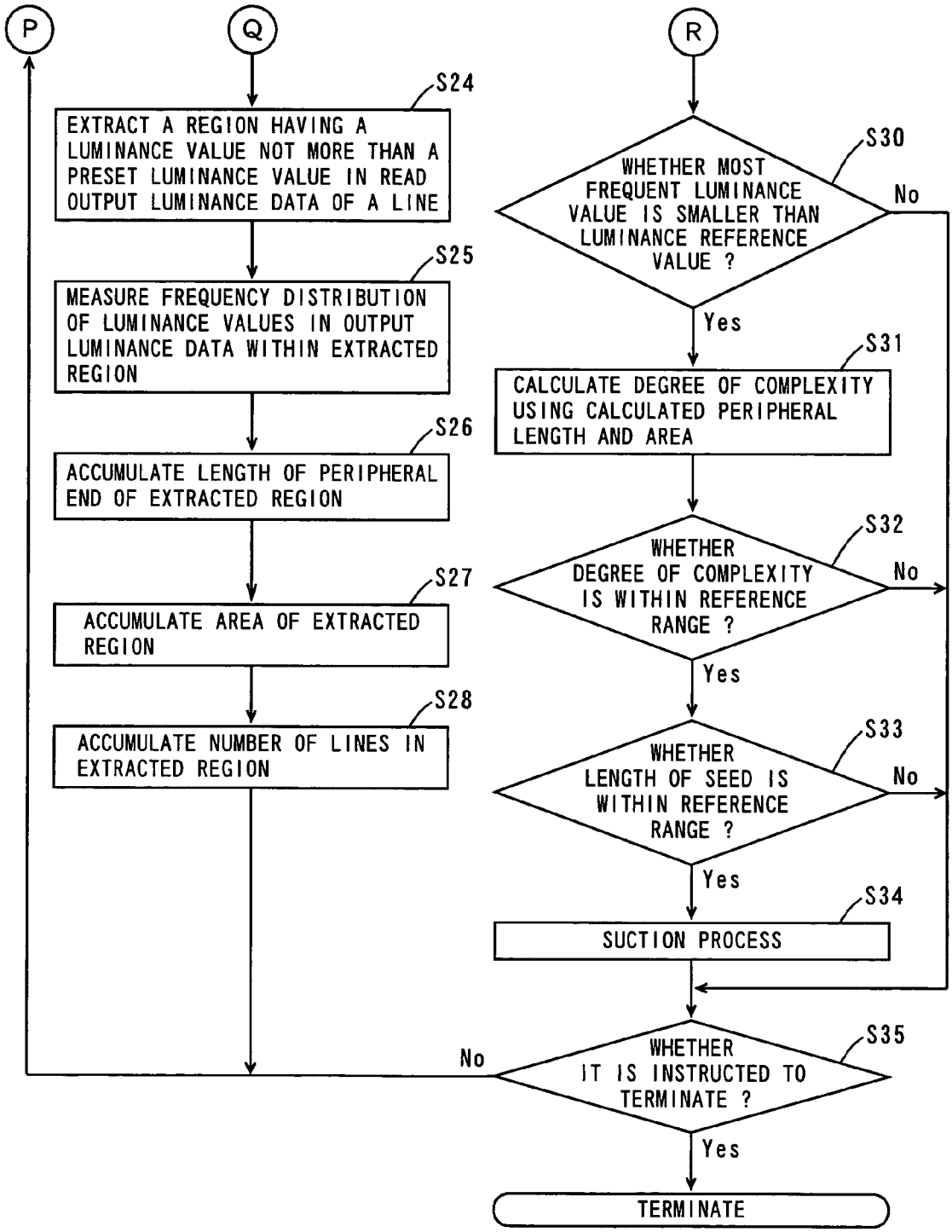
FIG. 17 is a flowchart showing a seed-sorting process performed by the control unit.

FIGS. 16 and 17 are flowcharts showing a seed-sorting process performed by the control unit 103. In the present embodiment, the seeds are sorted by sucking the black seeds 50. In the following, a length reference range, i.e., a reference range of the length of the seed, and a complexity reference range, i.e., a reference range of the degree of complexity, are set by manually inputting the result of examination performed in advance.

As shown in FIG. 16, the control unit 103 reads the output luminance data from the line sensor camera 101 for each line (Step S21).

The control unit 103 subsequently determines whether the sensed effective width is greater than the threshold value in three consecutive lines in the output luminance data from the line sensor camera 101 (Step S22). In the case where the sensed effective width is not greater than the threshold value in three consecutive lines, the control unit 103 continues reading the output luminance data from the line sensor camera 101.

In the case where the sensed effective width is greater than the threshold value in three consecutive lines, the control unit 103 determines whether the sensed effective width is smaller than the threshold value (Step S23). In the case where the sensed effective width is not smaller than the threshold value, the control unit 103 extracts a region having a luminance value not more than the preset luminance value in the read output luminance data of the line (Step S24 shown in FIG. 17).

The control unit 103 subsequently measures a frequency distribution of luminance values in the output luminance data within the extracted region (Step S25).

The control unit 103 then accumulates the length of the peripheral edge of the extracted region (Step S26).

The control unit 103 subsequently accumulates the area of the extracted region (Step S27).

After that, the control unit 103 accumulates the number of lines in the extracted region (Step S28).

The control unit 103 thereafter repeats the processes of Step S21 through S28 until the sensed effective width becomes smaller than the threshold value at Step S23 above.

The frequency distribution of the luminance values of the entire seed 50 is formed based on the measurement result obtained at Step S25. The accumulation result of the length of the peripheral edge obtained at Step S26 corresponds to the peripheral length of the seed 50. The accumulation result of the area obtained at Step S27 corresponds to the area of the seed 50. The accumulation result of the number of lines obtained at Step S28 corresponds to the length of the seed 50.

At step S23, the control unit 103 extracts a most frequent luminance value in the case where the sensed effective width is smaller than the threshold value (Step S29).

Then, the control unit 103 determines whether the most frequent luminance value is smaller than the luminance reference value described above (Step S30 shown in FIG. 17).

In the case where the most frequent luminance value is smaller than the luminance reference value, the control unit 103 calculates a degree of complexity using the calculated peripheral length and area (Step S31). The degree of complexity herein is expressed by $L^2/(4\pi S)$, wherein L is the peripheral length of the outer periphery of the seed 50, and S is the area of the seed 50. When the seed 50 has a shape of complete circle, the value of the degree of complexity is one. When the seed 50 is that of linearis, which is a kind of seed, the value of the degree of complexity is 1.0 to 1.3.

The control unit 103 subsequently determines whether the calculated degree of complexity is within the complexity reference range (Step S32).

In the case where the calculated degree of complexity is within the complexity reference range, the control unit 103 determines whether the length of the seed is within the length reference range (Step S33). It is noted that the length of the seed corresponds to the number of the lines having the average luminance value for each one unit within the measurement region not more than the sensed effective level, and the width not smaller than the sensed effective width.

In the case where the length of the seed is within the range of the length reference range, the control unit 103 performs suction process (Step S34). In this case, the control unit 103 transmits an instruction signal for instructing the sorting and suction device 106 to suck the seed.

The control unit 103 then determines whether it is instructed to terminate the operation (Step S35). In the case where it is not instructed to terminate the operation, the control unit 103 returns to Step S21 to repeat the processes above.

In the case where the most frequent luminance value is greater than the luminance reference value at Step S30, or the degree of complexity is not within the range of the reference range at Step S32, or the length of the seed is not within the reference range, the control unit 103 proceeds to Step S35.

When the control unit 103 is instructed to terminate the operation at Step S35, the seed-sorting process is terminated.

As described above, in the seed sorting apparatus according to the present embodiment, the seeds are sorted by comparing the most frequent luminance value and the value of the degree of complexity with the respective reference values, so that the seeds having the same color and different shapes, or the seeds having the same shape and different colors as those in the present embodiment, can be accurately sorted. In addition, the seeds 50 can be sorted from the foreign matter.

The seeds 50 can also be sorted that have similar shapes and colors while having different sizes, by comparing the length of the seed with the length reference value, in addition to the comparison of the most frequent luminance value and the degree of complexity with the respective reference values.

Moreover, the luminance reference value is automatically set by the luminance reference value calculation process even when there is a slight change in the color of the seed 50, so that the most frequent luminance value of the seed 50 and the luminance reference value can be accurately compared, and the seeds can also be sorted with high accuracy.

In addition, the frequency distribution of the luminance values of the seed 50 is formed by the control unit 103 with respect to the region having luminance values not more than the preset luminance value, thereby making it possible to eliminate the influence of the regions having luminance values not less than the preset luminance value, such as the outer periphery 50*b*, string part 50*c*, and surrounding of the seed 50. Accordingly, the seeds can be sorted with high accuracy.

In the present embodiment, the line sensor camera 101 corresponds to an image input device; the sorting and suction device 106 corresponds to a sorter; and the control unit 103 corresponds to a frequency distribution maker, a complexity calculator, a most frequent luminance extractor, a first storage, a second storage, a first comparator, a second comparator, a determiner, a reference value calculator, and a length calculator.

While in the present embodiment, the frequency distribution of the luminance values of the seed 50 is formed by the control unit 103 with respect to the image region having luminance values not more than the preset luminance value, this is not exclusive in the invention; the frequency distribution of the luminance values of the seed 50 may be formed with respect to the image region having luminance values within a predetermined range of the preset luminance value.

Moreover, while in the present embodiment, the degree of complexity is calculated in accordance with $L^2/(4\pi S)$, this is not exclusive in the invention; the degree of complexity may be calculated in accordance with $(4\pi S)/L^2$, which is the reciprocal number of that above-described embodiment. In this case, the reference range of the degree of complexity at Step S32 shown in FIG. 17 extends between the lower limit value and the upper limit value of the reciprocal number of the reference range of the above-described embodiment.

While the line sensor camera 101 is used in the present embodiment, this is not exclusive in the invention, and an area sensor camera may also be used.

In the seed sorting apparatus according to the present invention, sorting can be performed based on the luminance value within a predetermined range. As a result, it is possible to accurately sort the seeds even when some of the seeds have non-uniformity of color in the identical seeds, or when some of the seeds have no color at their peripheries or string parts.

Moreover, since the sorting is performed based on the frequency distributions of degrees of complexity and luminance values, it is possible to sort the seeds even when they have the same color and different shapes, or have the same shape and different colors. The seeds can also be sorted from foreign matter.

What is claimed is:

1. A sorting apparatus comprising:

an alignment apparatus that aligns a plurality of articles to be sorted in a plurality of rows while transporting the articles in a first direction;

a transport apparatus that transports said plurality of articles to be sorted supplied from said alignment apparatus in said first direction in the state of plurality of rows;

a line sensor that photographs a linear measurement region along a second direction perpendicular to said first direction in said transport apparatus;

a suction device having a plurality of suction units arranged along said second direction in a downstream side of said measurement region of said transport apparatus to suck said articles to be sorted in the respective plurality of rows transported by said transport apparatus;

a determiner that determines whether each of said articles to be sorted in the plurality of rows transported by said transport apparatus is to be selected or not selected based on an output signal from said line sensor, and outputs a determination result; and a controller that controls suction operation of each of said plurality of suction units of said suction device based on the determination result output from said determiner, wherein said alignment apparatus includes:

an alignment member having a plurality of grooves extending in parallel with one another along said first direction;

a vibration generation device that vibrates said alignment member so that the plurality of said articles to be sorted supplied on said alignment member move along said plurality of grooves, and an opening is provided in a bottom surface of each of said plurality of grooves of said alignment apparatus, and the width of the opening is set to form a bottom-surface region on which said articles to be sorted can pass on a side of the opening of each of the grooves.

2. The sorting apparatus according to claim 1, further comprising a recovery device that recovers an article to be sorted fallen through each of the openings of said alignment apparatus to supply the recovered article to an upstream side of said alignment apparatus.

3. A sorting apparatus comprising:

an alignment apparatus that aligns a plurality of articles to be sorted in a plurality of rows while transporting the articles in a first direction;

a transport apparatus that transports said plurality of articles to be sorted supplied from said alignment apparatus in said first direction in the state of plurality of rows;

a line sensor that photographs a linear measurement region along a second direction perpendicular to said first direction in said transport apparatus;

a suction device having a plurality of suction units arranged along said second direction in a downstream side of said measurement region of said transport apparatus to suck said articles to be sorted in the respective plurality of rows transported by said transport apparatus;

a determiner that determines whether each of said articles to be sorted in the plurality of rows transported by said transport apparatus is to be selected or not selected based on an output signal from said line sensor, and outputs a determination result; and a controller that controls suction operation of each of said plurality of suction units of said suction device based on the determination result output from said determiner, wherein said transport apparatus has a transporting surface that moves in said first direction, and said alignment apparatus supplies said plurality of articles to be sorted in the plurality of rows on said transporting surface.

4. The sorting apparatus according to claim 3, wherein a speed of said articles to be sorted in the plurality of rows transported by said transport apparatus is set to a value greater than a speed of said articles to be sorted in the plurality of rows transported by said alignment apparatus.

5. The sorting apparatus according to claim 3, wherein said alignment apparatus includes:

an alignment member having a plurality of grooves extending in parallel with one another along said first direction; and a vibration generation device that vibrates said alignment member so that the plurality of said articles to be sorted supplied on said alignment member move along said plurality of grooves.

6. A sorting apparatus comprising:

an alignment apparatus that aligns a plurality of articles to be sorted in a plurality of rows while transporting the articles in a first direction;

a transport apparatus that transports said plurality of articles to be sorted supplied from said alignment apparatus in said first direction in the state of plurality of rows;

a line sensor that photographs a linear measurement region along a second direction perpendicular to said first direction in said transport apparatus;

a suction device having a plurality of suction units arranged along said second direction in a downstream side of said measurement region of said transport apparatus to suck said articles to be sorted in the respective plurality of rows transported by said transport apparatus;

a determiner that determines whether each of said articles to be sorted in the plurality of rows transported by said transport apparatus is to be selected or not selected based on an output signal from said line sensor, and outputs a determination result; and a controller that controls suction operation of each of said plurality of suction units of said suction device based on the determination result output from said determiner, wherein said controller instructs a corresponding suction unit to perform suction operation after the elapse of a predetermined time from the time point when the article to be sorted in each of the rows is determined to be selected by said determiner.

7. The sorting apparatus according to claim 6, wherein said suction device comprises a main part having a gas path; and a tubular nozzle having one opening end and another opening end, and inserted into said gas path so that said one opening end projects from said main part, wherein a gap is provided between at least part of an outer surface of said tubular nozzle and an inner surface of said gas path, and said main part has a gas flow-in path communicating with said gap and having a larger cross section than that of said gap, and the suction device further comprising a gas creating device that creates a gas flow via the gas flow-in path running from the side of said one opening end toward the side of said other opening end in said gap.

8. A sorting apparatus comprising:

an alignment apparatus that aligns a plurality of articles to be sorted in a plurality of rows while transporting the articles in a first direction;

a transport apparatus that transports said plurality of articles to be sorted supplied from said alignment apparatus in said first direction in the state of plurality of rows;

a line sensor that photographs a linear measurement region along a second direction perpendicular to said first direction in said transport apparatus;

a suction device having a plurality of suction units arranged along said second direction in a downstream side of said measurement region of said transport apparatus to suck said articles to be sorted in the respective plurality of rows transported by said transport apparatus;

a determiner that determines whether each of said articles to be sorted in the plurality of rows transported by said transport apparatus is to be selected or not selected based on an output signal from said line sensor, and outputs a determination result; and a controller that controls suction operation of each of said plurality of suction units of said suction device based on the determination result output from said determiner, wherein said determiner detects a width of said article to be sorted in said second direction based on said output signal from said line sensor, and determines that said article to be sorted is being transported by said transport apparatus when said width in said second direction is greater than a predetermined value consecutively a predetermined number of times.

9. A sorting apparatus comprising:

an alignment apparatus that aligns a plurality of articles to be sorted in a plurality of rows while transporting the articles in a first direction;

a transport apparatus that transports said plurality of articles to be sorted supplied from said alignment apparatus in said first direction in the state of plurality of rows;

a line sensor that photographs a linear measurement region along a second direction perpendicular to said first direction in said transport apparatus;

a suction device having a plurality of suction units arranged along said second direction in a downstream side of said measurement region of said transport apparatus to suck said articles to be sorted in the respective plurality of rows transported by said transport apparatus;

a determiner that determines whether each of said articles to be sorted in the plurality of rows transported by said transport apparatus is to be selected or not selected based on an output signal from said line sensor, and outputs a determination result; and a controller that controls suction operation of each of said plurality of suction units of said suction device based on the determination result output from said determiner, wherein after said determiner determines that said articles to be sorted are being transported by said transport apparatus, said determiner measures a distribution of luminances of said measurement region to determine whether each of the articles to be sorted is to be selected or not selected based on a most frequent luminance.

* * * * *